US012527986B2

(12) United States Patent
Kassel et al.

(10) Patent No.: US 12,527,986 B2
(45) Date of Patent: Jan. 20, 2026

(54) EXERCISE MACHINE EMPLOYING ONE OR MORE FLEXIBLE EXERCISE BANDS

(71) Applicants: Blake Kassel, Boca Raton, FL (US); Michael McErlane, Westlake Village, CA (US)

(72) Inventors: Blake Kassel, Boca Raton, FL (US); Michael McErlane, Westlake Village, CA (US)

(73) Assignee: Blake Kassel, Boca Raton, FL (US)

( * ) Notice: Subject to any disclaimer, the term of this patent is extended or adjusted under 35 U.S.C. 154(b) by 183 days.

(21) Appl. No.: 18/226,507

(22) Filed: Jul. 26, 2023

(65) Prior Publication Data

US 2024/0149096 A1 May 9, 2024

Related U.S. Application Data

(60) Provisional application No. 63/423,926, filed on Nov. 9, 2022.

(51) Int. Cl.
*A63B 21/04* (2006.01)
*A63B 21/00* (2006.01)

(52) U.S. Cl.
CPC ..... *A63B 21/0421* (2013.01); *A63B 21/4035* (2015.10); *A63B 2225/09* (2013.01); *A63B 2225/102* (2013.01)

(58) Field of Classification Search
CPC ..... A63B 21/0421; A63B 21/4035; A63B 2225/09; A63B 2225/102
See application file for complete search history.

(56) References Cited

U.S. PATENT DOCUMENTS 4,618,144 A 10/1986 Gibson
5,135,216 A * 8/1992 Bingham ..... A63B 21/05 482/52
5,486,150 A 1/1996 Randolph
5,599,261 A 2/1997 Easley et al.
5,616,111 A 4/1997 Randolph
(Continued)

FOREIGN PATENT DOCUMENTS

KR 20210044379 A 4/2021

OTHER PUBLICATIONS

International Search Report from related PCT Application No. PCT/US2023/033689 dated Jan. 11, 2024.
English abstract of KR20210044379A.

*Primary Examiner* — Joshua T Kennedy
(74) *Attorney, Agent, or Firm* — Caesar Rivise, PC

(57) ABSTRACT

An exercise machine includes at least one tension band and a pair of rotatable exercise arms to be engaged by opposed hands of an individual. Vertically spaced apart connectors are located, respectively, on the exercise arms and on frame members vertically above and below the exercise arms. A flexible tension band connectable to vertically spaced connectors, whereby rotation of the exercise arms in upward or downward directions stretches the flexible tension band to create a tension force opposing the upward or downward rotation of the exercise arms. The machine includes spaced-apart rotatable side arms; each preferably including telescopic sections. A connector adjacent outer ends of each side arm includes a connector adjacent an outer end for retaining a flexible tension band engaged directly by an individual or connected to the exercise arms.

18 Claims, 26 Drawing Sheets

(56) References Cited

U.S. PATENT DOCUMENTS

| | | | | |
|---|---|---|---|---|
| 5,722,922 | A | 3/1998 | Watterson et al. | |
| 10,779,645 | B2 * | 9/2020 | Siaperas | A63B 21/4033 |
| 2007/0155597 | A1 * | 7/2007 | Hockemeyer | A63B 21/0783 482/99 |
| 2009/0098987 | A1 * | 4/2009 | McBride | A63B 21/023 482/133 |
| 2013/0210592 | A1 * | 8/2013 | Hoole | A63B 21/0552 482/129 |
| 2015/0038300 | A1 * | 2/2015 | Forhan | A63B 21/154 482/142 |
| 2019/0269963 | A1 * | 9/2019 | Steenekamp | A63B 23/1254 |
| 2019/0275363 | A1 * | 9/2019 | Jones | A63B 21/0616 |
| 2022/0193477 | A1 * | 6/2022 | Gedeon-Janvier | A63B 21/062 |
| 2023/0016392 | A1 * | 1/2023 | Kaye | A63B 23/03508 |

* cited by examiner

EXERCISE MACHINE EMPLOYING ONE OR MORE FLEXIBLE EXERCISE BANDS

RELATED APPLICATION

This non-provisional application claims the benefit under 35 U.S.C. § 119(e) of the filing date of provisional application Ser. No. 63/423,926, filed on Nov. 9, 2022, and entitled EXERCISE MACHINE EMPLOYING ONE OR MORE FLEXIBLE EXERCISE BANDS and the subject matter of which is all incorporated by reference herein.

FIELD OF THE INVENTION

This invention relates generally to an exercise machine and more particularly to an exercise machine employing one or more flexible tension, or exercise bands.

BACKGROUND OF THE INVENTION

One well-known exercise device is known by the trademark BOWFLEX, and includes a plurality of fairly rigid, elongate, fiberglass rods that bend to provide resistance by flexing, much like a bow for propelling arrows. This machine connects the bow-like members to a manually engageable member through a pulley system.

Applicant is not aware of any prior art exercise machines capable of employing one or more flexible tension (stretchable) bands; most preferably flexible exercise bands that, in addition to be employed in the exercise machine of this invention, also are capable of being used independently of the machine to provide manual exercises. It is to such an exercise machine that the present invention relates. In accordance with the broadest aspects of the invention the flexible tension bands can be of any design and are not limited to conventional tension bands on the market.

SUMMARY OF THE INVENTION

This invention relates to an exercise machine in which tension is provided by one or more flexible tension (stretchable) bands, and most preferably without the use of any pulley system.

An exercise machine employing one or more flexible tension bands in accordance with this invention includes a pair of exercise arms rotatably mounted on frame members at locations vertically above a surface supporting the exercise machine, said pair or exercise arms being horizontally spaced-apart and being configured to be engaged by opposed hands of an individual located between said pair of exercise arms, at least one set of connectors associated with each of said exercise arms, said connectors of each set including first and second connecting members vertically spaced from each other and being configured to be connected, respectively, to said exercise arms and to a machine member above and/or below the rotatable mount of the exercise arms, at least one flexible tension band being configured to be connected to said first and second, vertically spaced-apart connecting members of at least one set of connectors, whereby when said at least one flexible tension band is connect to said first and second, vertically spaced-apart connecting members of at least one set of connectors associated with each exercise arm rotation of the exercise arms in one of said upward and/or downward directions is opposed by a tension force imposed on said tension bands by said rotational movement of the exercise arms.

In a preferred embodiment of this invention, the exercise machine includes a platform provided between the horizontally spaced-apart exercise arms and below the rotatable mount of the exercise arms to support an individual engaging the opposed arms during exercising.

In a preferred embodiment of the invention, the second connecting member of each set of connecting members is configured to be connected to said platform below the rotatable mount of the exercise arms and to component(s) of the machine above the rotatable mount of the exercise arms, whereby, when said one or more elongate tension bands is (are) connected to one or more connecting members on said rotatable arm and to one or more second connecting members on said platform rotation of the exercise arms in an upward direction is opposed by a tension force created by the elongation or stretching of the one or more tension bands, and when said one or more elongate tension bands is (are) connected to one or more connecting members on said rotatable arms and to one or more second connecting members above the rotational mount of the exercise arms rotation of the exercise arms in a downward direction is opposed by a tension force created by the elongation or stretching of the one or more tension bands.

In a preferred embodiment of this invention, one of said connecting members of each set of connectors is in the form of a closed loop for receiving a respective tension band therein and supporting said respective tension band intermediate its ends, said other of said connecting member of each set including a pin member, said opposed ends of said respective tension bands that are supported by said closed loop including attachment members thereon for attachment to a respective pin member.

More preferably, said closed loops of each set of connectors are attached to a platform below the rotational mount of the exercise arms, and optionally to said frame member(s) above the rotational mount of the exercise arms and said pins of each set of connectors are attached to the exercise arms.

In the most preferred embodiments of this invention, the flexible tension bands are folded on themselves and opposed ends thereof include connectors for attachment to looped connector, preferably a D-ring, and an intermediate section of each tension band is retained over a pin connected to the exercise arm either above or below the looped connector In the most preferred embodiment of this invention each exercise arm includes inner and outer sections rotatably mounted to each other about a vertical axis to permit rotational movement or adjustment of the outer section of each exercise arm relative to the inner section of each exercise arm during an exercise in which each of the exercise arms is rotated either upwardly or downwardly during an exercise.

In the most preferred embodiment of this invention the rotatably mounted inner and outer sections of each exercise arm can be locked in one or more different rotatable orientations relative to each other or can remain unlocked during use to permit rotational movement of said inner and outer sections relative to each other during an exercise in which the arms are being rotated either upwardly or downwardly against the tension of one or more tension bands.

In the most preferred embodiment of this invention the exercise machine includes side arms rotatably mounted to vertically spaced-apart frame members for rotation between uppermost and lowermost positions and being configured to be locked in different rotational positions, said side arms being rotatably mounted on frame members of said machine in a plane generally perpendicular to the plane in which the exercise arms are rotatably mounted for carrying out an exercise.

In the most preferred embodiment of this invention each of the side arms is configured to be retained in a position in which a connector adjacent an outer end thereof is vertically spaced above the rotational mount of the exercise arms, said connector of each side arm being configured to retain one or more flexible tension bands that are configured to be connected to the exercise arms, whereby, when said one or more flexible tension bands are connected to the exercise arms, downward rotational movement of said exercise arms stretches said one or more flexible tension bands to provide a resistive force opposing said downward rotational movement.

In the most preferred embodiment of this invention each of the side arms includes telescopic inner and outer sections to permit adjustment of the spacing between the rotatable connection of each inner section of a side arm to a frame member of the machine and a connector adjacent an outer end of a telescopic outer section of said side arm.

References to orientation or position of members of the machine, e.g., upper, lower, vertically spaced, etc. refers to the orientation or position of members relative to a surface on which the exercise machine is supported, e.g., floor, platform, etc.

Reference to "flexible tension band" or "flexible exercise band," unless otherwise specified, means a flexible, elongate member that is stretchable to provide a tension force in a direction opposed to the direction of stretching.

DETAILED DESCRIPTION OF SPECIFIC EMBODIMENTS OF THE INVENTION

The description herein is illustrative of preferred embodiments of the invention and is not intended to limit the scope of the invention as described and claimed.

Figure 1:
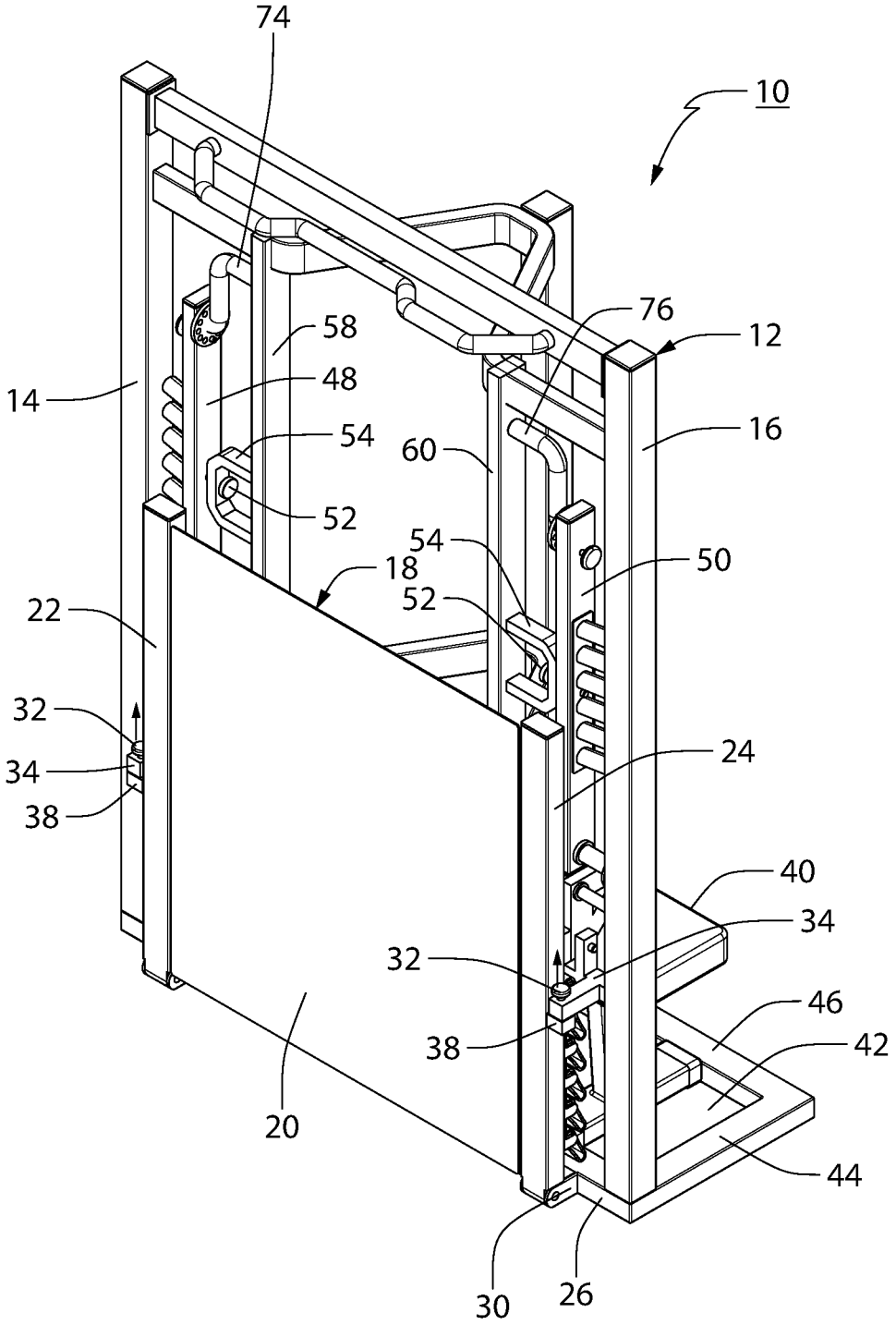
FIG. 1 is a front, prospective view of an exercise machine in accordance with this invention with parts folded or retracted to provide compactness when the devise is not in use.

An exercise machine including features of this invention is shown at 10 in FIGS. 1-16. FIG. 1 shows the exercise machine 10 in a folded or retracted position to conserve space when the machine is not in use.

The exercise machine 10 has a frame assembly 12 including a number of frame members including vertically oriented, spaced apart frame members 14, 16.

A platform 18 includes a deck 20 and frame members 22, 24 rotatably connected to a transversely extending front base frame members 26 through devises 28, 30. (see FIGS. 1, 3 and 4). Although the inclusion of the platform is preferred and provides desirable benefits, in the broadest aspects of this invention the platform may be omitted and the exercise machine stabilized by bolting frame members to the floor, or by the use of other stabilizing systems.

When not in use the platform 18 is retained in a retracted position, as shown in FIG. 1, through the cooperation of spring-loaded pins 32 retained within members 34 attached to vertically oriented, spaced apart frame members 14, 16, said spring-loaded pins 32 being biased normally into passages 36 of members 38 extending outwardly from frame members 22, 24 of the platform 18. (See FIGS. 1 and 3-6). This same arrangement for maintaining platform 18 in a retracted position is employed in the more preferred embodiment of exercise machine 200, to be described in detail infra.

By pulling spring-loaded pins 32 upwardly, in the direction of the arrows shown in FIG. 1, the pins are pulled out of engagement with the corresponding passages 36 of members 38 to permit rotation of the platform 18 into a horizontal position for use of the exercise machine 10. (See FIGS. 3 and 4). Specifically, in one preferred embodiment the deck 20 of the platform is configured to support a bench 40 on which an individual using the exercise machine is supported during exercising; either sitting or in a supine position. Alternatively, an individual using the machine can be directly supported on deck 20, without use of a bench or other body-supporting structure. The provision of platform 18 including the deck 20 is a desirable feature of the most preferred embodiments of this invention since a person on the deck, either with or without a bench imposes a downward force on the machine to aid in stabilizing the machine 10 during its use. Without the inclusion of platform 18, other means would be required to stabilize the machine 10; such as bolting frame members of the machine to its supporting surface.

Figure 2:
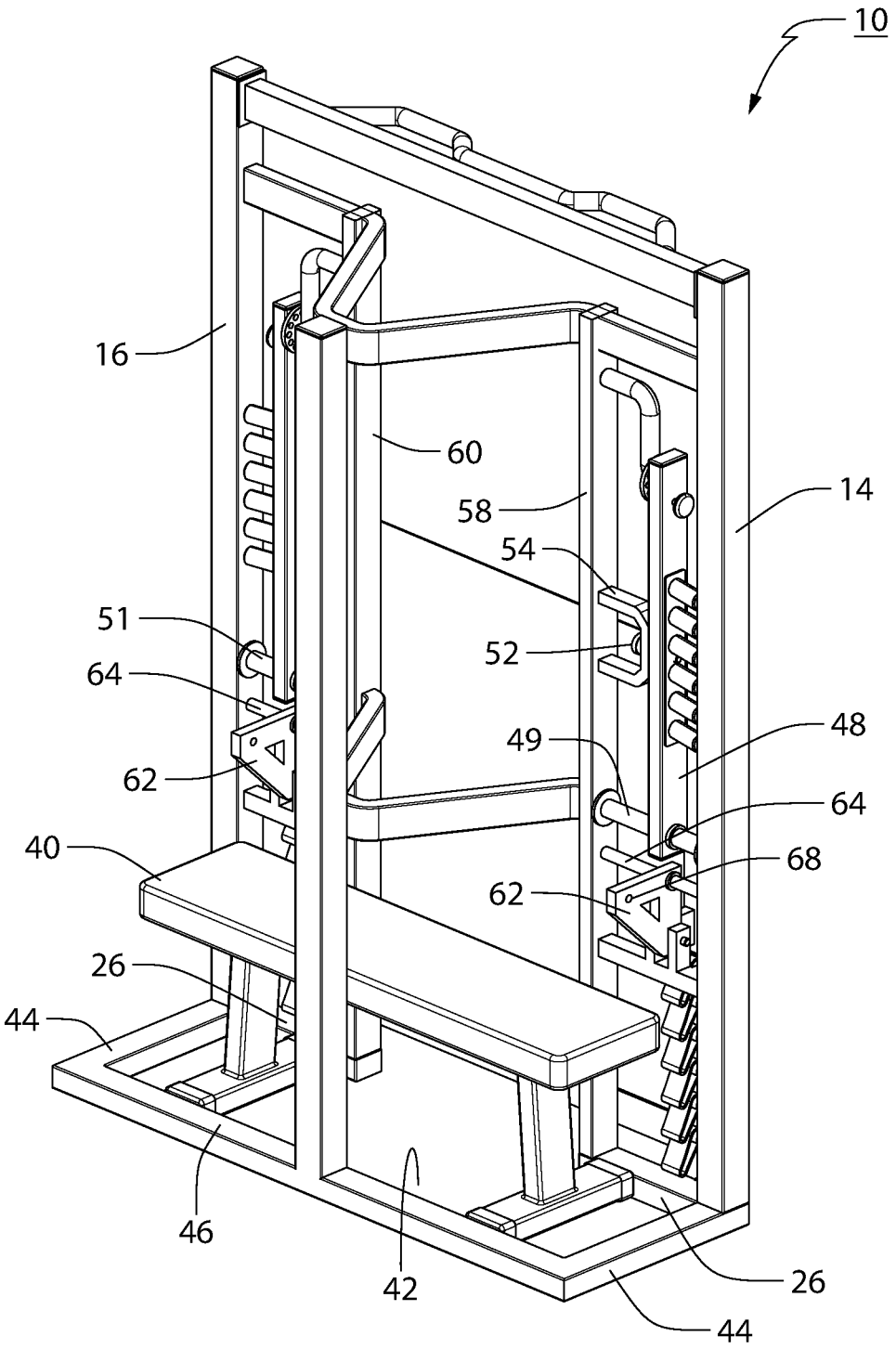
FIG. 2 is a rear, prospective view of the exercise machine shown in FIG. 1.

Referring to FIG. 2, when the bench is not in use it can be retained within a storage area 42 provided by the transversely extending front base frame members 26, side base frame members 44, and transversely extending rear base frame member 46, The inclusion of storage are 42 is not required in accordance with the broadest aspects of this invention. In fact, in the more preferred exercise machine 200 such a storage area is not included; to provide a more compact construction.

As can be seen in FIGS. 1-4, rotatably mounted exercise arms 48, 50 are retained in a retracted position when the exercise machine is not in use. In this retracted position the arms 48, 50 preferably are within the vertical plane provided by the vertically oriented, spaced apart frame members 14, 16 to provide a desirable, compact construction when the machine 10 is not in use.

Figure 3:
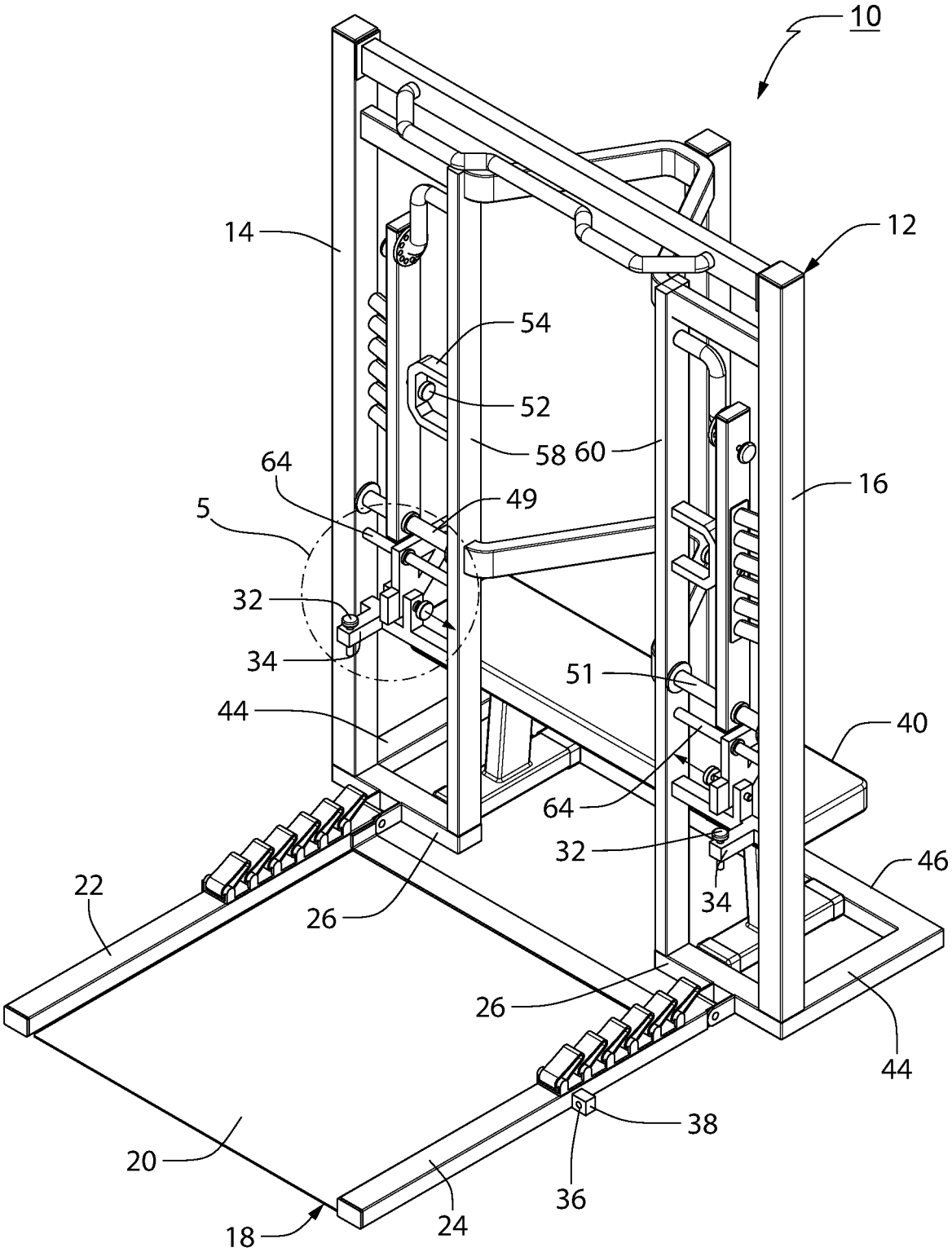
FIG. 3 is a front, prospective view similar to FIG. 1, but with the supporting platform in an opened position for use of the machine and with the support for exercise arms of the machine still in a retracted position.
Figure 7:
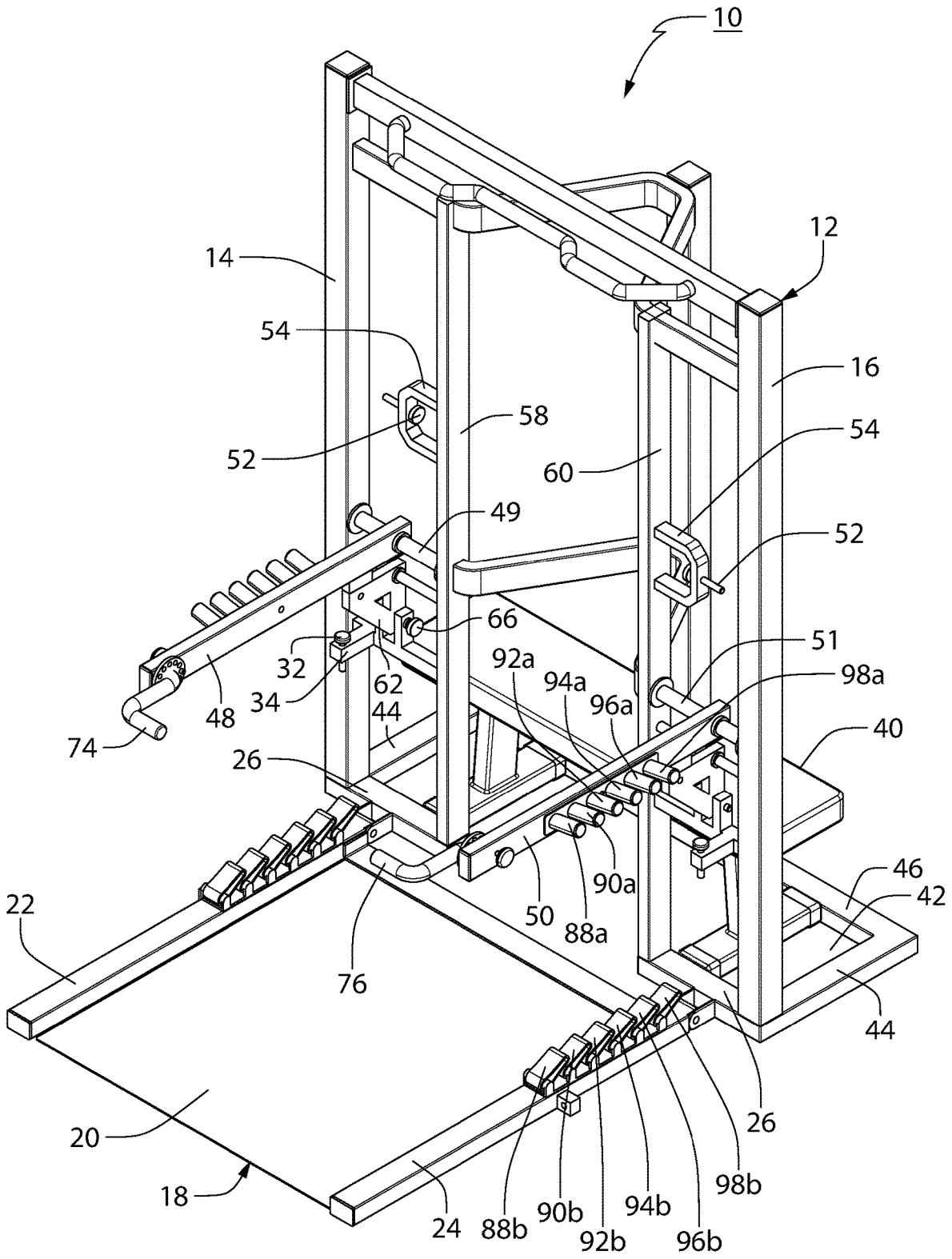
FIG. 7 is a prospective view of the machine similar to FIG. 4, and with the exercise arms rotated into their active lower position for using the machine.

Referring to FIGS. 1-3, the exercise arms are retained in the retracted position by the engagement of pins 52 spring loaded in U-shaped members 54 (or other similar members) to normally engage within openings 56 on the inner surface of the exercise arms 48, 50 (one such opening being shown in exercise arm 48 in FIG. 7). The U-shaped members 54 are retained, by welding or any other suitable means, to vertically extending frame members 58, 60 of the frame assembly 12 of the exercise machine 10. It should be noted that this same arrangement for maintain exercise arms in a retracted position is employed in the more preferred exercise machine 200, which will be described in detail later in this application.

Figure 4:
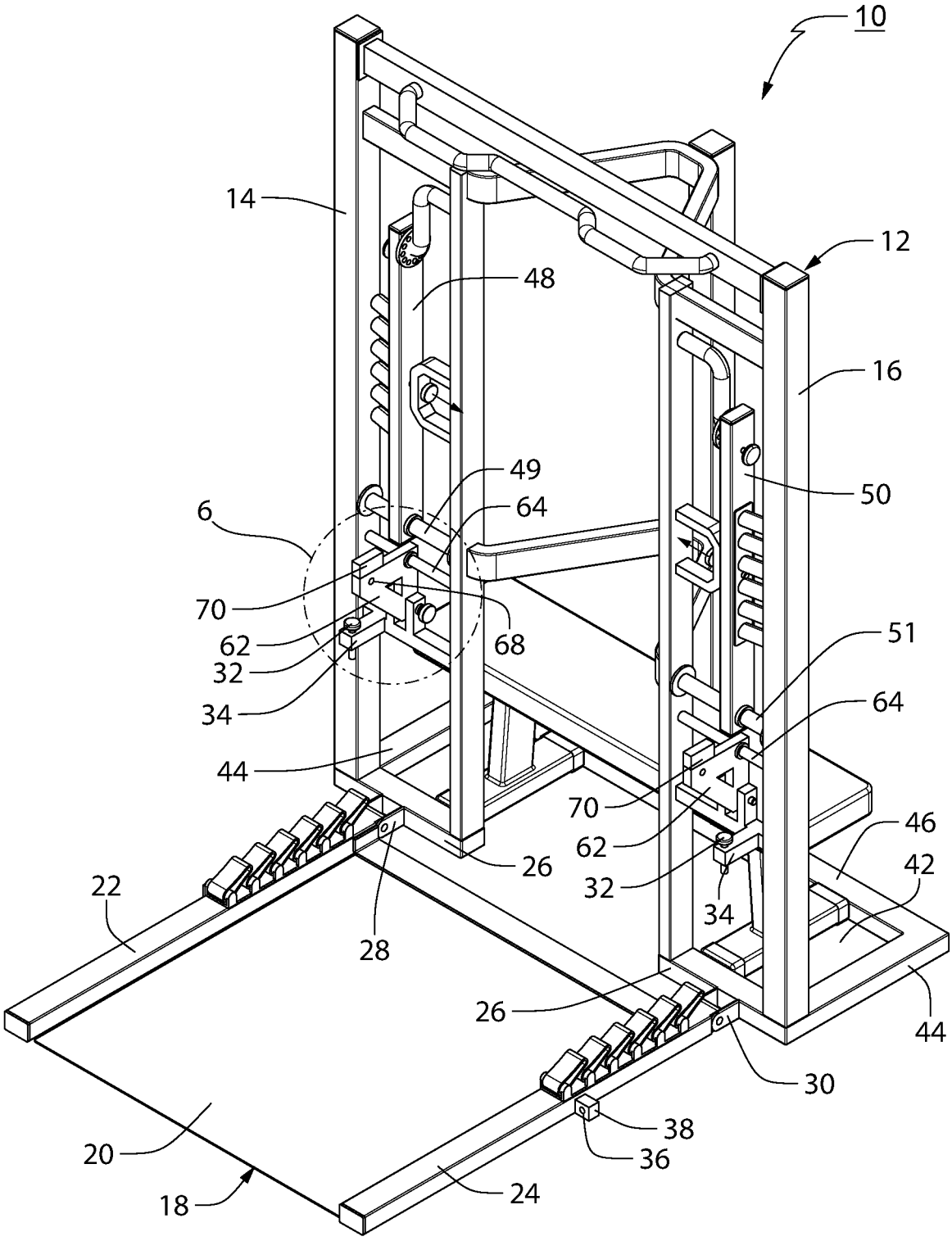
FIG. 4 is a front, prospective view similar to FIG. 3, but showing the support for the exercise arms rotated into an active position to support the exercise arms when they are in their desired, lowermost position.
Figure 8:
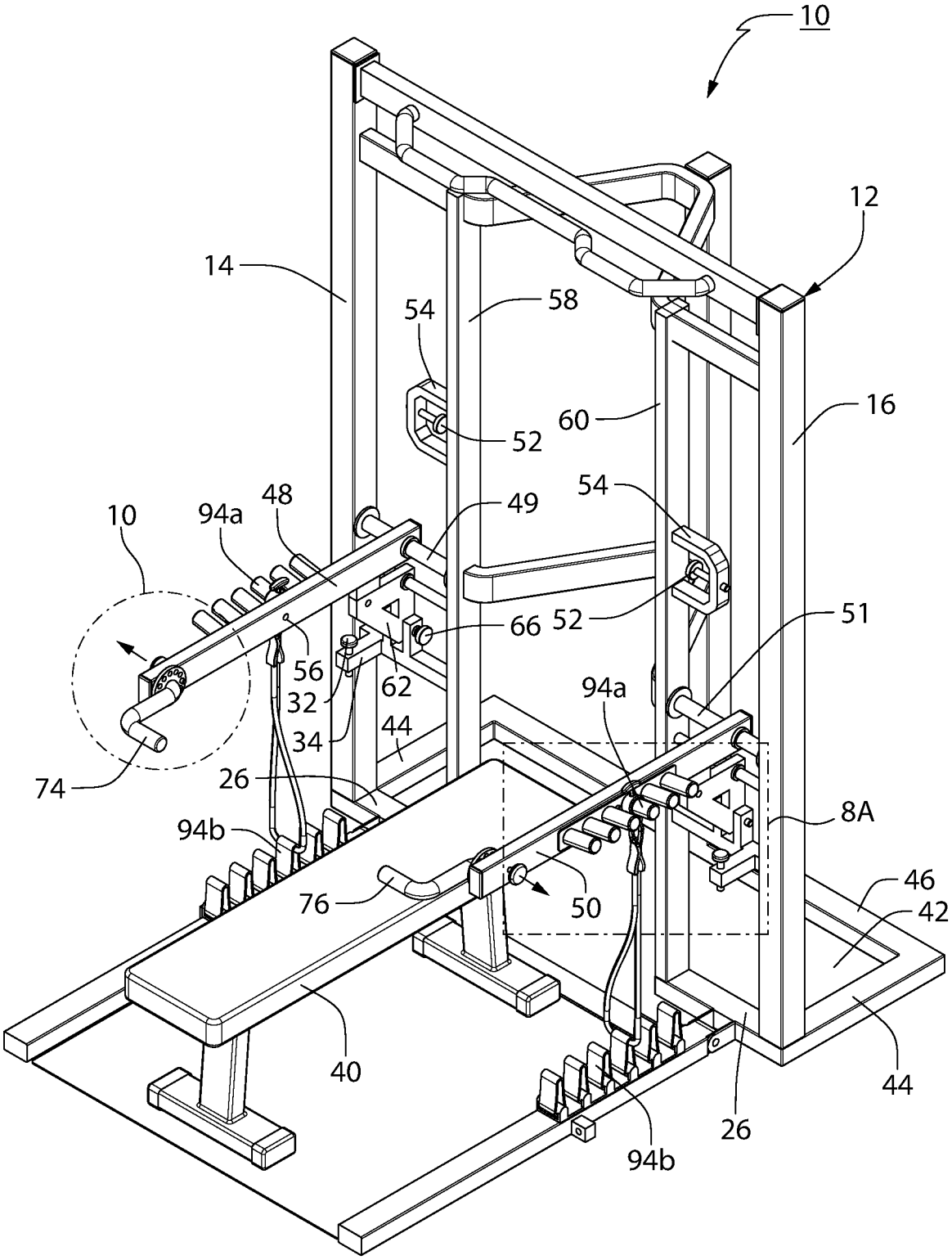
FIG. 8 is a prospective view of the machine similar to FIG. 7, showing hand-engaging members attached in the exercise arms in one desired position, and showing the connection of one exercise band to each exercise arm for providing a force opposing upper, clockwise rotational movement of the exercise arms during exercising.
Figure 9:
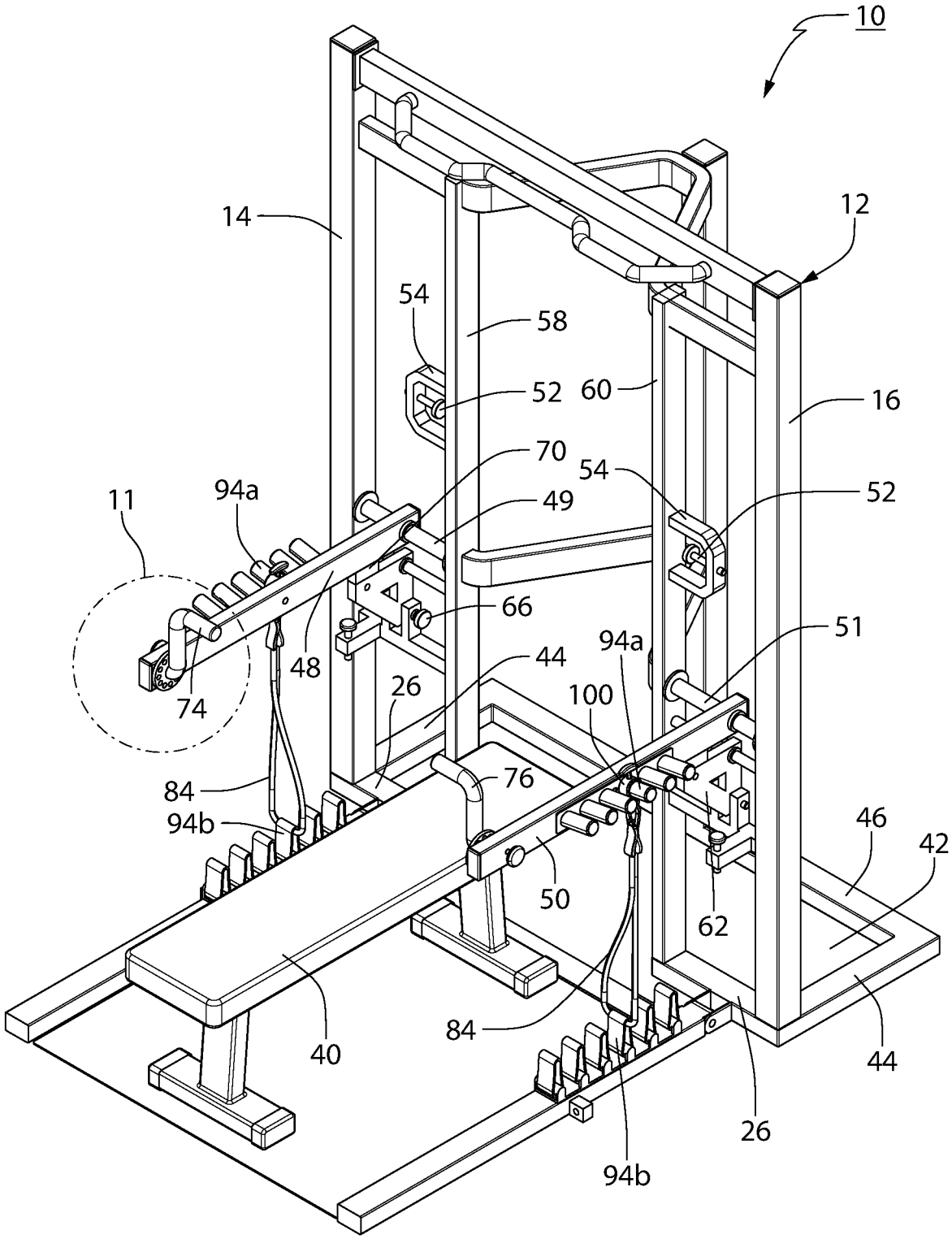
FIG. 9 is a prospective view of the machine similar to FIG. 8, but showing the hand-engaging members attached to the exercise arms in an alternate position to that shown in FIG. 8.

Referring to FIG. 4, when the pins 52 (preferably spring-loaded) are pulled in the direction of the arrows, they will disengage from the corresponding openings 56 of the exercise arms 48, 50 to permit those arms to rotate about axles 49, 51 into an operative position, as shown in FIGS. 7-9.

Referring to FIGS. 2 and 5-7, the exercise machine 10 preferably is provided with rotatably mounted exercise arm-engaging members 62; one for each of the exercise arm 48 and 50. Each arm-engaging member 62 is identical and is rotatably mounted about an axle 64 from an inactive, or non-operative position shown best in FIGS. 3 and 5, to an operative, arm-engaging position shown best in FIGS. 2, 4 and 6-8. The exercise arms 48 and 50 can be mounted for axial movement along axles 49, 51, respectively, to permit adjustment of the spacing of the arms from each other to accommodate individuals having different statures. In a like manner, the arm-engaging members 62 can be mounted for axial movement along their respective axles 64 to be positioned in alignment with the arm-engaging members to provide their desired supporting function, as is described in greater detail hereinafter. The same arrangement of rotatably mounted exercise arm-engaging members, and the mounting of both the exercise arms and the exercise arm-engaging members for axial movement along their respective rotational axles is employed in the more preferred exercise machine 200, which will be described in detail later I this application.

As will be described in detail hereinafter with respect to the most preferred embodiment of this invention shown in FIGS. 17-29 (i.e., exercise machine 200), each of the exercise arms preferably are provided by two sections rotatably mounted relative to each other, and preferably, one of the sections includes telescopic members.

Figure 5:
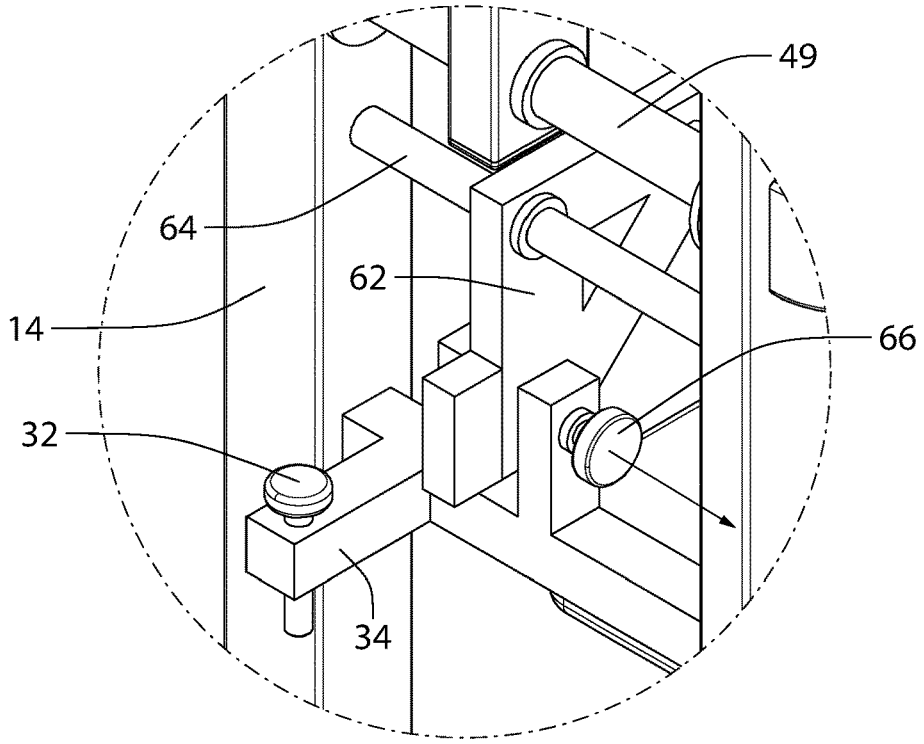
FIG. 5 is an enlarged isometric view of the circled region identified as "5" in FIG. 3, showing the support for the exercise arms in a retracted position.

Referring to FIG. 5, a locking pin 66 normally is spring biased into a passage 68 (one being shown in FIG. 6) in each of the arm-engaging member 62 to retain each arm-engaging member in a non-operative position. This position is maintained when the exercise machine 10 is not in use and permits the components of the machine 10 to be maintained in a desired, retracted condition. The arm-engaging members 62 also are maintained in a non-operative position when the exercise arms 48, 50 are being rotated downwardly against an opposing force created by the stretching of flexible tension bands.

Figure 6:
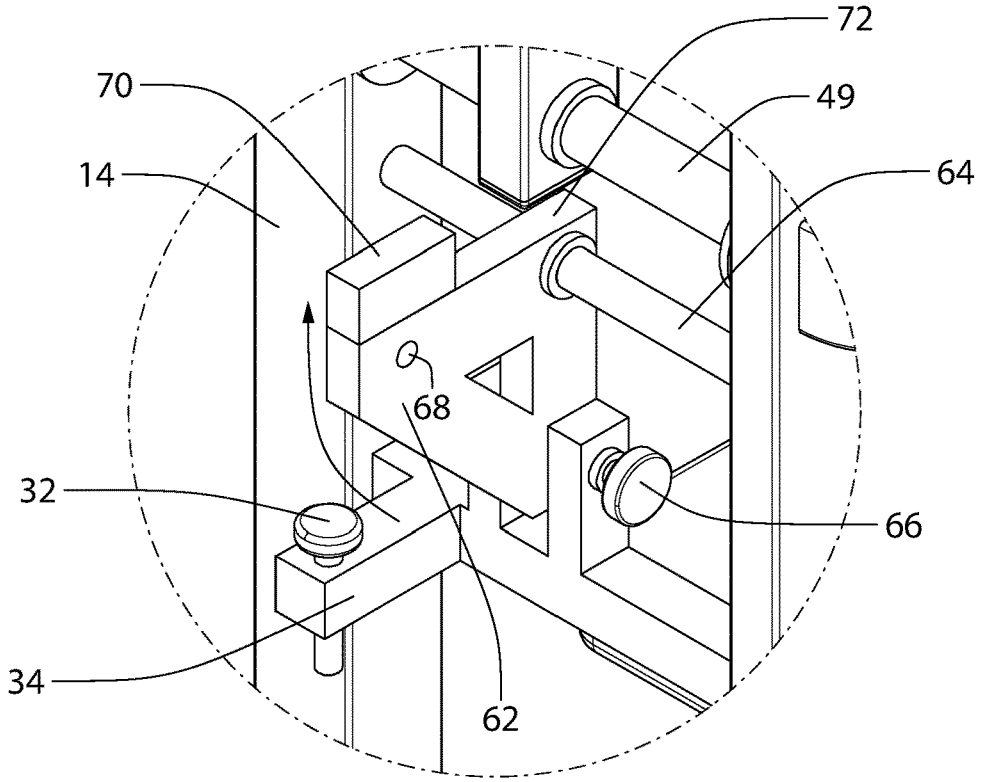
FIG. 6 is an enlarged isometric view of the circled region identified as "6" in FIG. 4, showing the support for the exercise arms in an active position for supporting or engaging the exercise arms when they are in their desired, lowermost position.

Referring to FIGS. 5 and 6, when it is desired to use the exercise machine, and provide support for the exercise arms 48, 50 in a desired starting position, each locking pin 66 is pulled outwardly as shown in FIG. 5, to release the pin from its engagement with its corresponding passage 68, and permit clockwise rotation of the arm-engaging members 62 in the direction shown by the arrow in FIG. 6, into an operative position for supporting each exercise arm in a desired position prior to the beginning of an exercise in which the arms are rotated in an upward direction against a tension force provided by the stretched exercise bands. When in an operative position the locking pin is spring biased into a corresponding passage (not shown) in the arm-engaging members 62.

Referring to FIGS. 6-8 a cushioning member or pad 70 preferably is attached to upper surface 72 if each arm-engaging member 62 when the arm-engaging members 62 are in an active position to support exercise arms 48, 50, to provide a cushioning effect when the rotatable exercise arms are moved into engagement with respective arm-engaging members.

Referring to FIGS. 8-11, each of the exercise arms 48, 50 preferably includes a rotatably adjustable gripping handle 74, 76, at the distal ends thereof for engagement by a person during exercising. FIG. 8 shows the gripping handles 74, 76 in one desired orientation and FIG. 9 shows the gripping handles in a second, desired orientation rotated approximately 90 degrees from the position shown in FIG. 8.

Figure 10:
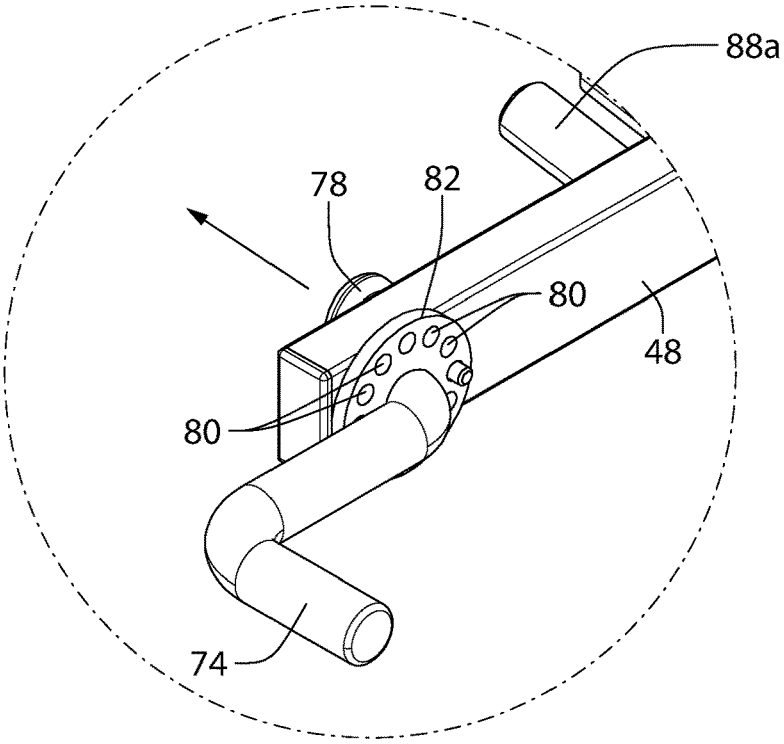
FIG. 10 is an enlarged prospective view of the circled region identified as "10" in FIG. 8.
Figure 11:
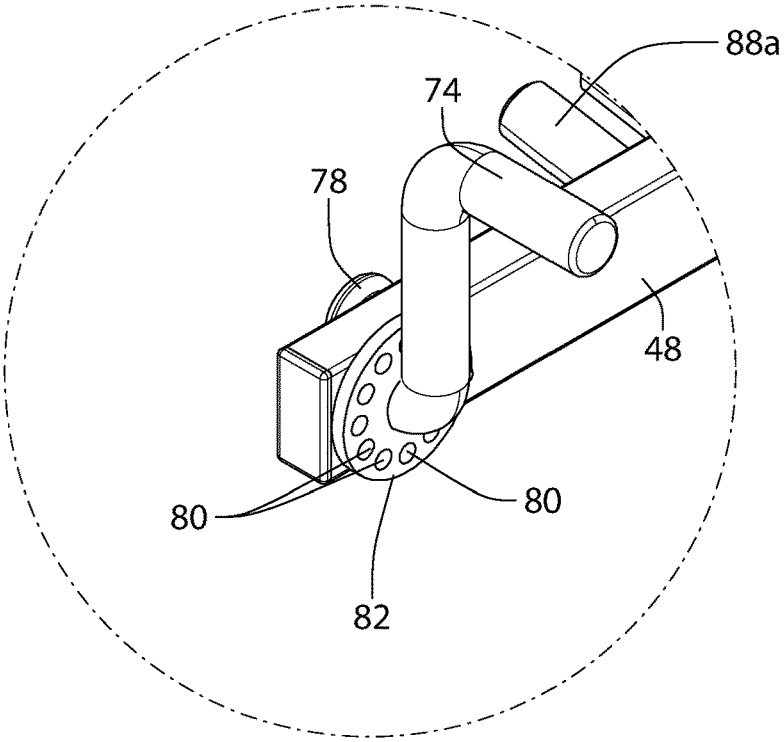
FIG. 11 is an enlarged prospective view of the circled region identified as "11" in FIG. 9.
Figure 12:
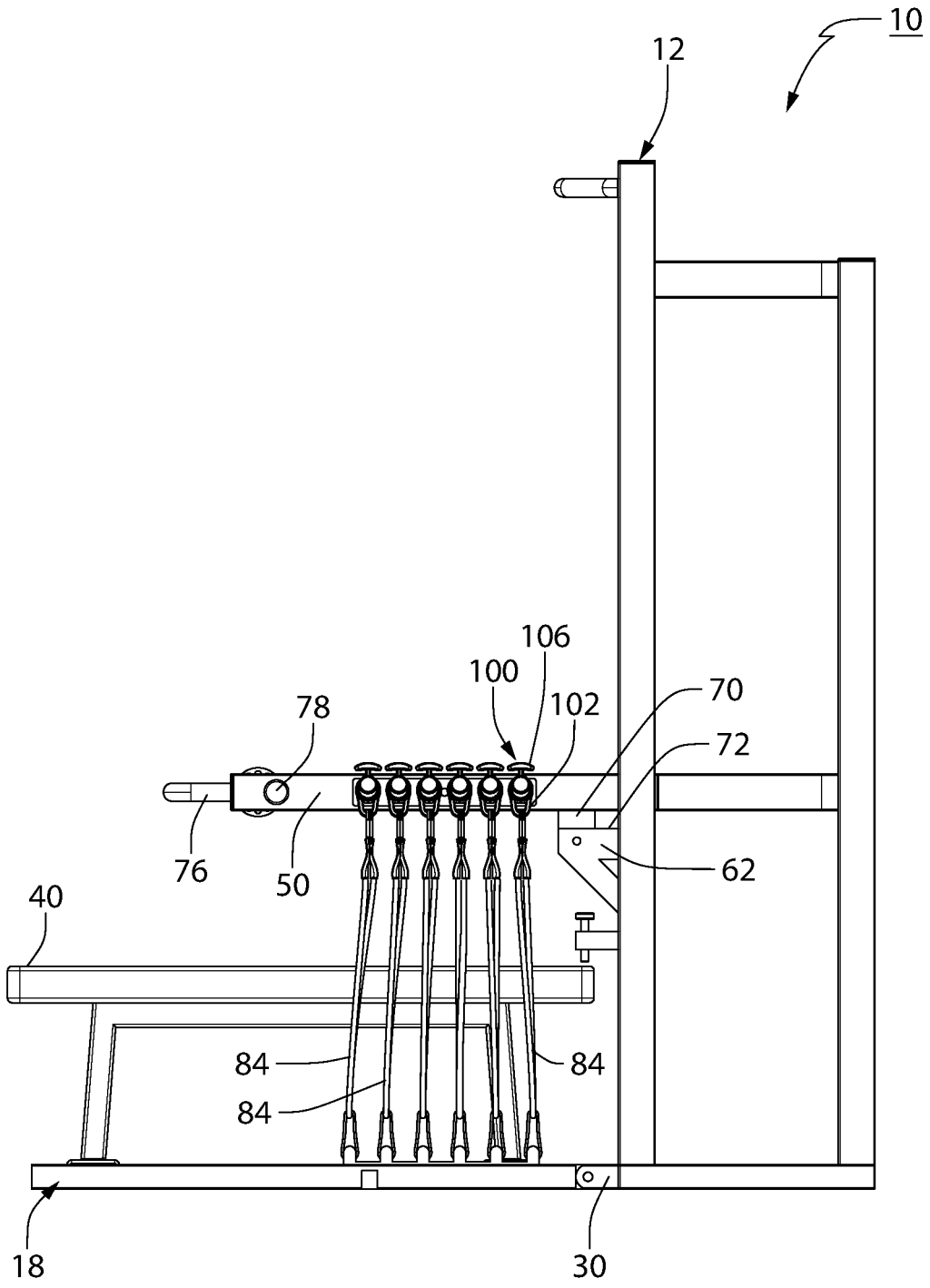
FIG. 12, is a side view of the exercise machine showing a plurality of six (6) exercise bands connected between the platform and one exercise arm; it being understood that the same arrangement of six (6) exercise bands is connected between the platform and the other of said exercise arms.

Referring to FIGS. 10 and 11, the arrangement for permitting rotational adjustment of the gripping handle 74 relative to exercise arm 48 will be described, it being understood that the exact same arrangement is provided for permitting rotational adjustment of gripping handle 76 relative to exercise arm 50. A spring-loaded locking pin 78 is normally spring-loaded inwardly to engage within a desired opening 80 of flange 82 to which the gripping handle 74 is secured, When it is desired to change the position of the gripping handle 74, the locking pin 78, which can be spring loaded inwardly, is pulled outwardly in the direction of the arrow shown in FIG. 10 to permit the handle 74 to be rotated into a desired position, e.g., the position shown in FIG. 11. In this new, desired position the locking pin 78 is spring biased into an aligned opening 80 in the flange 82 to maintain the gripping handle 74 in its new position. As stated earlier, the gripping handle 76 is attached to its corresponding exercise arm 50 in this same manner. In accordance with the broadest aspects of this invention the gripping handles 76 need not be rotatably mounted relative to the exercise arms, or other arrangements can be employed to provide rotation of handles relative to exercise arms. In a preferred embodiment of exercise machine 200 disclosed in FIGS. 17-29, the same manner is employed to rotatably mount gripping handles 248 to inner telescopic members 212 of outer sections 208 of the exercise arms 202, 204.

Referring to FIGS. 7-9 and 12, one arrangement will be described for permitting one or more flexible exercise bands 84 to be employed in the exercise machine 10 to provide a desired resistance during exercising when the exercise arms 48, 50 are rotated in an upward direction during an exercise. This arrangement also can be employed in the more preferred embodiment of this invention disclosed as exercise machine 200 in FIGS. 17-29.

Arrangements for permitting one or more flexible exercise bands 84 to be employed in the machine 10 to provide a desired resistance when the exercise arms 48, 50 are rotated in a downward direction during an exercise will be described in connection with FIGS. 13-15. However, the more preferred arrangement for providing this resistance is employed in the exercise machine 200 disclosed in FIGS. 17-29 and will be described in detail hereinafter with respect to that machine.

Referring to FIGS. 7-9 and 12, the flexible exercise band(s) most preferably are configured to be manually usable apart from the exercise machine 10 of this invention. By way of example, the exercise bands 84 can be of the type disclosed in U.S. Pat. No. 8,657,727; including opposed ends provided by carabineers 86 attached to tethers. The subject matter of the '727 patent is fully incorporated herein by reference. However, it should be understood that this invention is not limited to the use of any specific flexible exercise bands; however, the exercise bands usable in this invention are flexible and preferably are of the type that have or can be employed for use in manual exercises; apart from use in the exercise machines 10 and 200 of this invention. However, in accordance with the broadest scope of this invention, any flexible exercise band within the definition set forth earlier in this application can be employed in all embodiments of this invention.

The exercise machine 10 includes one or more sets of connectors; six such sets being shown by way of example in FIG. 7. Each of said sets preferably is identical; each including first and second connecting members vertically spaced from each other. As illustrated the first and second connecting members of each set are designated by the same number followed by the suffix "a" and "b" respectively. For example, the first and second connecting members of one of the six sets are identified as 88*a* and 88*b*, respectively.

In the preferred embodiment of this invention the first connector 88*a*, 90*a*, 92*a*, 94*a*, 96*a* and 98 of the six sets are in the form of connection pins or projections attached to, and extending outwardly of each of the exercise arms 48, 50. In a more preferred embodiment included in machine 200, and also usable in the exercise machine 10, each connecting pin can includes a flange 297 at a distal end thereof to aid in maintaining the connection between each pin and a connector 100 employed to connect exercise bands to the pins, as will be described in detail hereinafter. The second connector 88*b*, 90*b*, 92*b*, 94*b*, 96*b* and 98*b* of each of the six sets are in the form of loops, such as fabric loops or D-rings secured to the upper surface of frame members 22, 24 of the platform 18. Fabric loops are disclosed in the exercise machine 10, and D-rings are disclosed in the exercise machine 200. However, in accordance with the broadest aspects of this invention; applicable to both exercise machines 10 and 200, other types of connectors may be used in the respective sets; so long as the first and second connectors in each set are vertically spaced-apart from each other.

In all embodiments of this invention, the number of sets of first and second, vertically spaced-apart connectors can be varied. In the machine 200 only three such sets are employed.

Figure 8A:
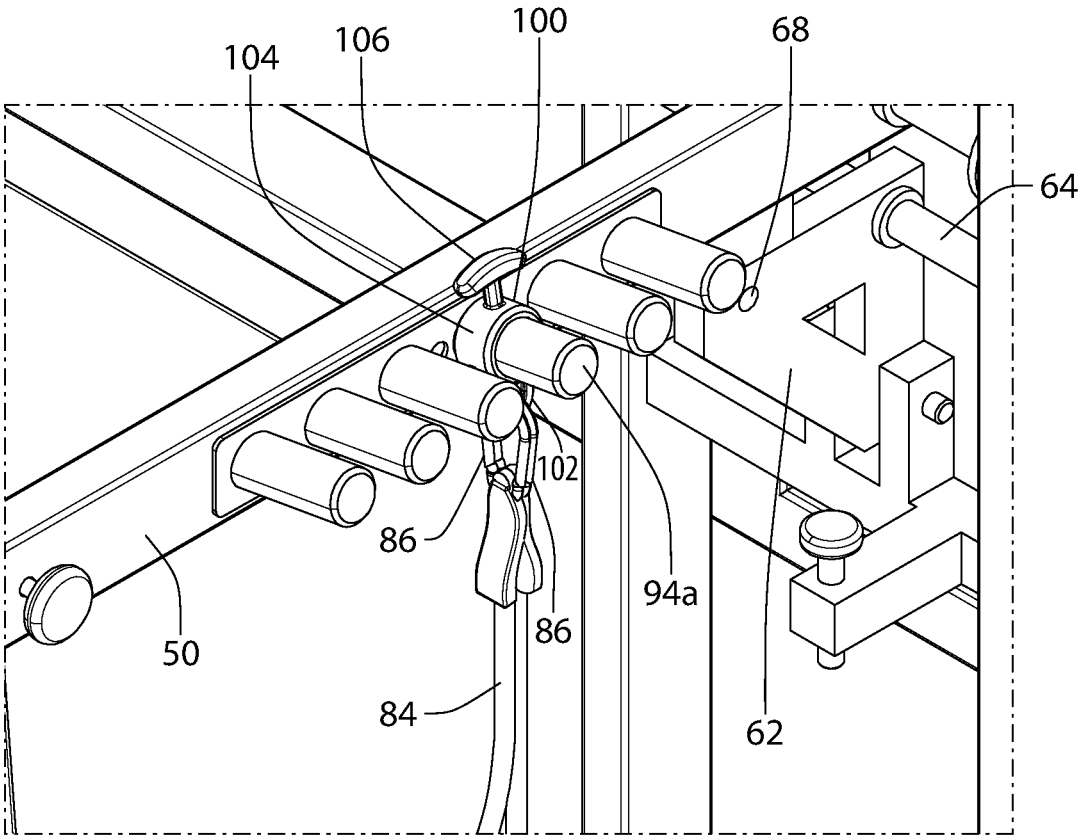
FIG. 8A is an enlarged view of the region identified as "8A" in FIG. 8 showing details of the connection of opposed ends of a tension band to one of the exercise arms through a unique connector of this invention.

Referring to FIGS. 8 and 8*a*, a preferred arrangement for connecting a flexible exercise band 84 to a set of connectors 94 (which include pin or projection 94*a* and a cooperating loop 94*b*) will be described. Specifically, the exercise band 84 is directed through the passage of loop 94*b* and is engaged within the loop intermediate its ends. Carabineers 86 constituting opposed ends of the exercise bands are connected to pin or projection 94*a* preferably through a unique connector 100. This same arrangement can be employed in the more preferred exercise machine 200 disclosed in FIGS. 17-29. Moreover, as stated earlier, each of the pins can include an enlarged flange 297 at the distal end to prevent the exercise band(s) from inadvertently separating from a respective pin. The use of such a flange is shown in the more preferred exercise machine 200 in FIG. 24.

Figure 14:
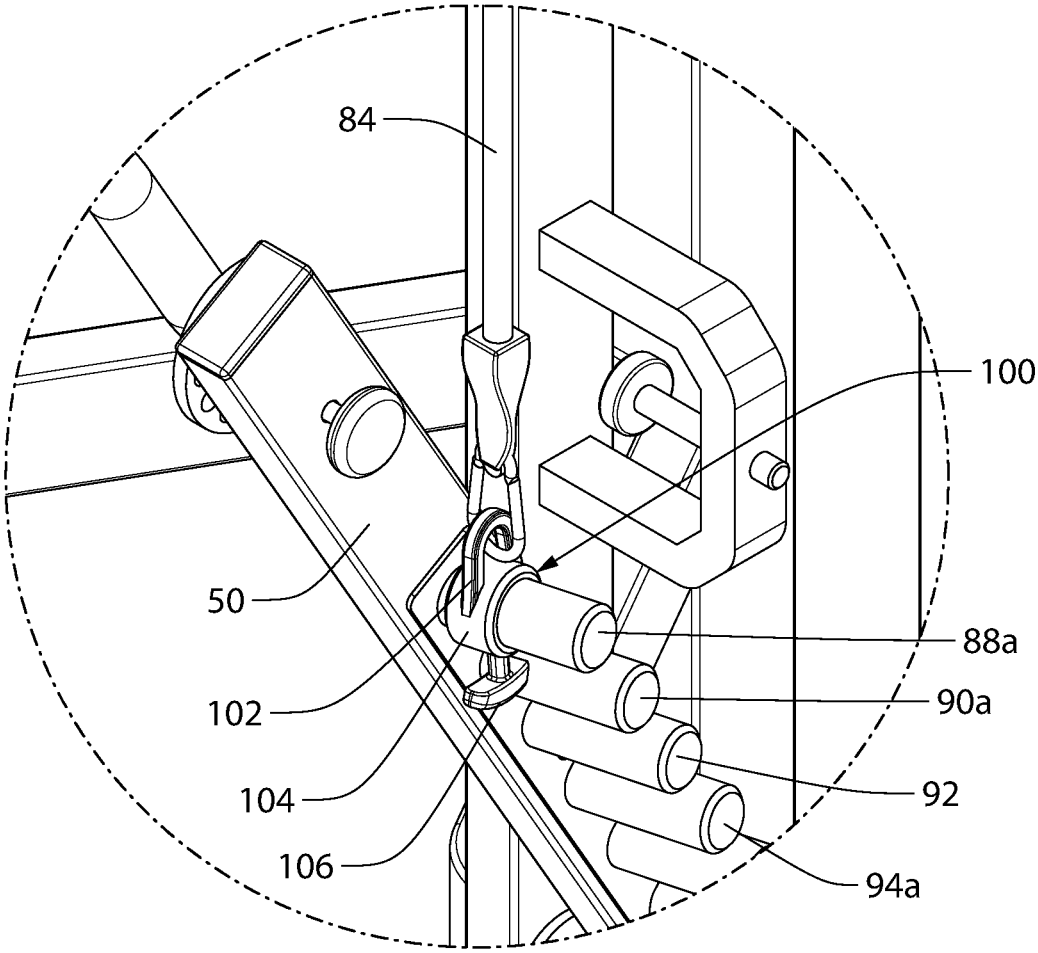
FIG. 14 is an enlarged view of the region "13" circled in FIG. 13.
Figure 16:
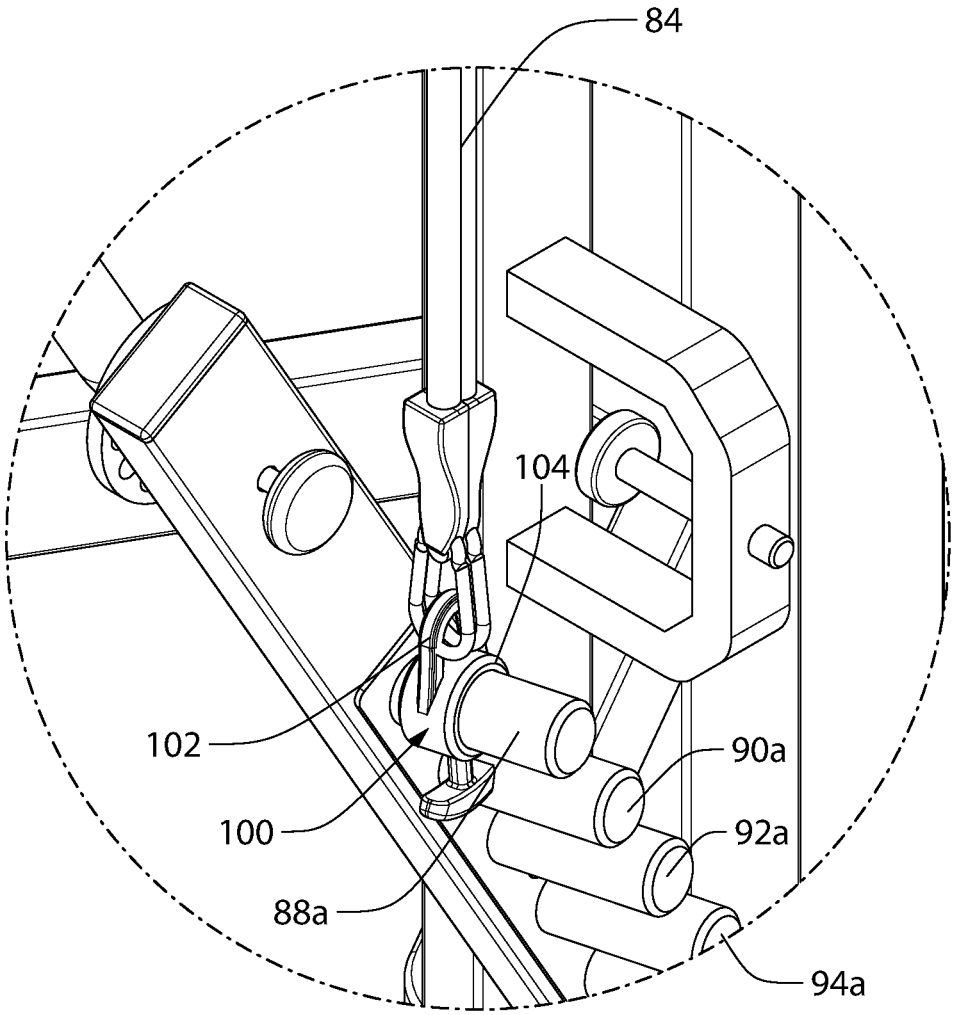
FIG. 16 is an enlarged view of the region "16" circled in FIG. 15.

Referring specifically to FIG. 8*a*, and also FIGS. 14 and 16 to be discussed infra, the connector 100 includes an open section 102, in the form of a clevis into which the carabineers 86 are attached. As noted earlier, devices other than carabineers may be used to connect flexible exercise bands within the open section 102. The connector 100 also includes an open pin-engaging section 104 configured to be received over pin or projecting member 94*a*, as shown in FIG. 8*a*. A handle or gripping member 106 preferably is provided or connected to the peripheral wall of the pin-engaging section of connector 100 to permit the easy, manual insertion or removal of the connector 100 to or from a corresponding pin or projecting member, as desired. It should be noted that the arrangement disclosed in this paragraph also can be employed in the exercise machine 200 disclosed in FIGS. 17-29.

During use of the machine 10, the flexible exercise bands connected to vertically spaced-apart connectors should be under tension; with no slack. The arrangement of connector 100 with the handle 106 thereon permits the easy, manual connection of each flexible exercise band 84 over a corresponding pin, e.g., 88*a*-98*a* while under tension. As noted earlier, in accordance with the broadest aspects of this invention, fastening devices other than carabineers can be employed as part of the flexible exercise bands, and fasteners other than pins 88*a*-98*a* can be employed on the exercise arms 48 and 50. When the exercise arms 48, 50 are rotated upwardly the exercise band(s) 84 will be stretched to provide resistance to rotation of the exercise arms by an individual exercising. The degree or amount of resistance will depend upon the particular band or bands employed in the machine 10, and the number of bands that are employed. The arrangement described herein also is applicable for use in the exercise machine 200 disclosed in FIGS. 17-29.

Figure 13:
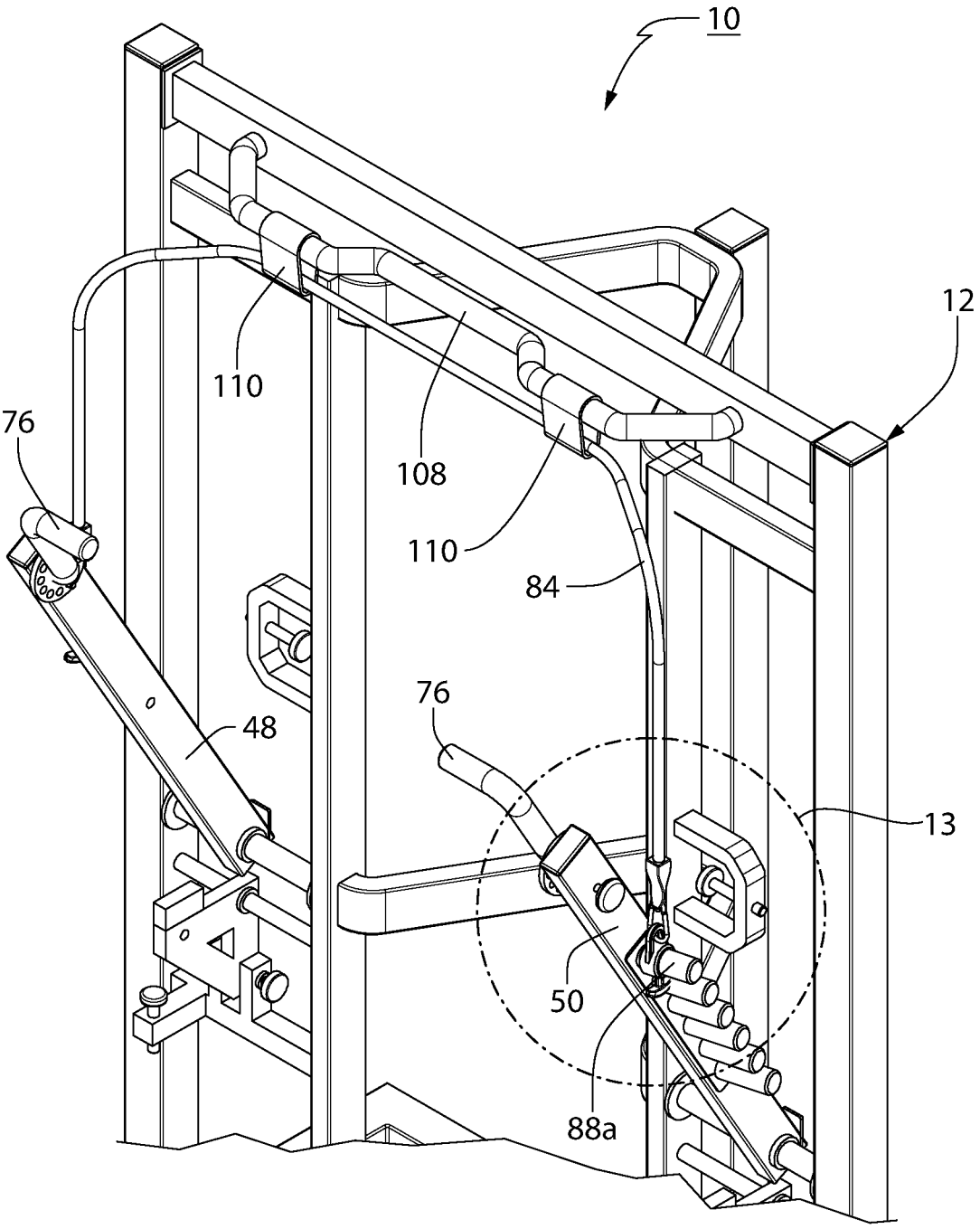
FIG. 13, is a partial prospective view showing the top portion of an exercise machine of this invention, showing an arrangement for attaching flexible tension bands to rotatable arms of the machine in a manner to permit the tension bands to be stretched by downward rotation of the exercise arms; the lower or bottom portion of the machine being the same as described earlier in connection with other embodiments of this invention.
Figure 15:
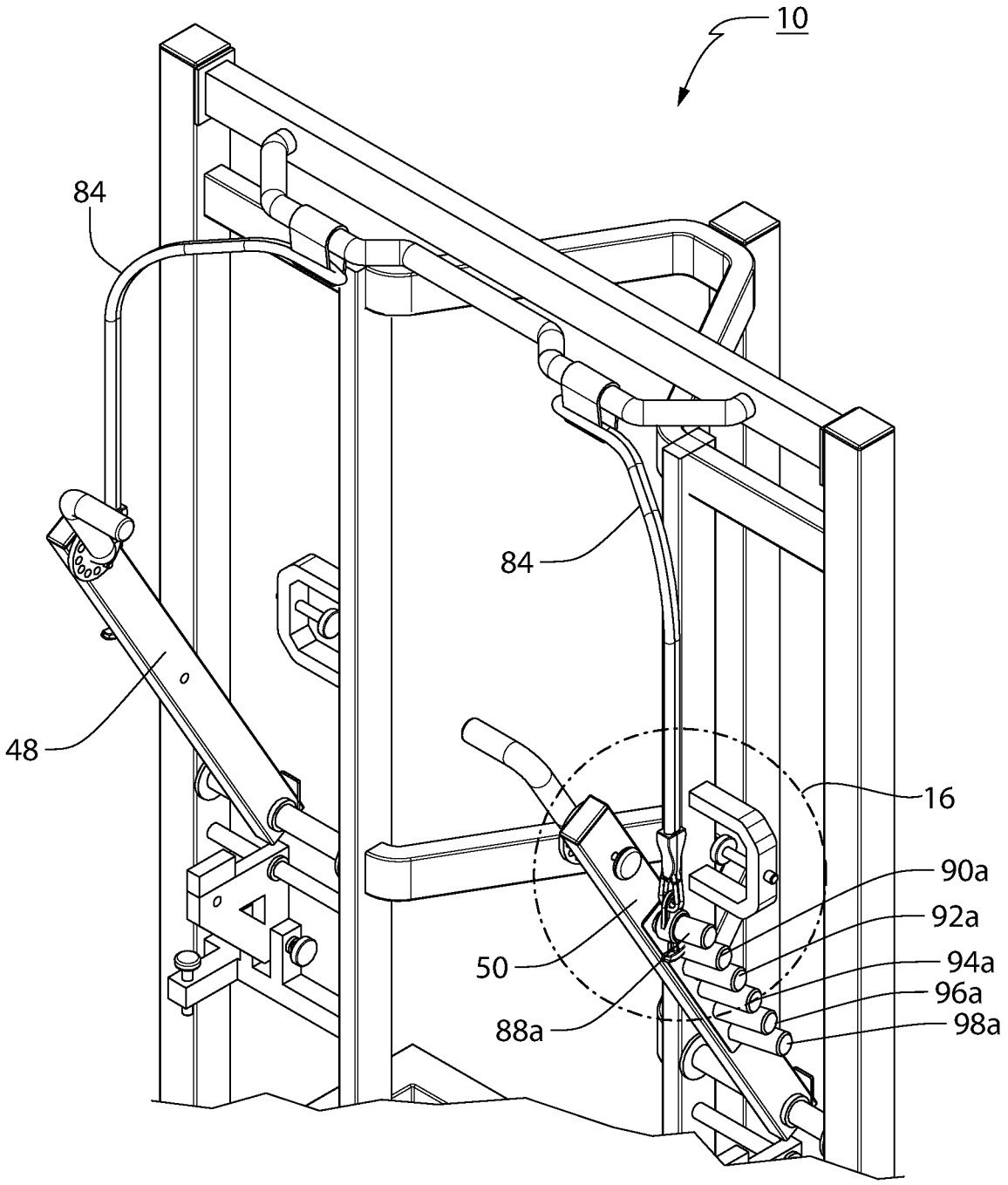
FIG. 15 is a partial prospective view showing the top portion of an exercise machine of this invention, showing an alternative arrangement for attaching flexible tension bands to rotatable arms of the machine in a manner to permit the tension bands to be stretched by downward rotation of the exercise arms; the lower or bottom portion of the machine being the same as described earlier in connection with other embodiments of this invention.

Referring to FIGS. 13-15, an arrangement is shown for permitting exercises in which the exercise arms 48, 50 are rotated downwardly to stretch the flexible exercise band(s) 84 and thereby provide resistance to the downward rotation of the exercise arms. However, a more preferred arrangement is employed in exercise machine 200 and will be described in detail hereinafter.

Referring to FIG. 13, each of the exercise arms 48, 50 is of the same construction as in the earlier embodiments of this invention, and preferably includes pins 88*a*-98*a*, as connectors for the flexible exercise bands 84. The exercise machine 10 includes an upper, horizontal frame member 108 to which are attach connectors 110, preferably in the form of spaced-apart loops. As can be seen in FIG. 13, exercise bands 84 (only one being shown) are threaded through the loops 110, with the opposed ends thereof connected to the pins of the spaced apart exercise arms 48, 50. It should be understood that the loops 110 also are includable in embodiments of the invention shown in FIGS. 1-12.

Referring to FIG. 14, the connection of each end of the flexible exercise bands to the pins includes the connector 100 employed in the same manner as described earlier. The major difference in the FIG. 13 embodiment is that each flexible exercise band is connected to both of the exercise arms 48, 50.

Referring to FIG. 15, the structure of machine 10 is identical to the construction shown in FIG. 13; the only difference being the manner in which the flexible exercise bands 84 are attached to provide tension or resistance during downward rotation of the exercise arms 48, 50. This embodiment employs a similar connection system to the one employed in the embodiment shown in FIGS. 1-12. Specifically, separate flexible exercise bands 84 are connected to each of the exercise arms 48, 50, respectively, Each flexible exercise band 84 is positioned through one loop 110 attached to frame member 108, and the opposed ends of the exercise bands are connected to a respective pin attached to one of the exercise arms through a connector 100, in the same manner as the connection is made in the embodiment shown and described in connection with FIGS. 1-12. This connection is shown best in FIG. 16, which is an enlarged view of the circled region "16" in FIG. 15.

The most preferred embodiment of the exercise machine is shown at 200 in FIGS. 17 through 29. A number of the elements of the exercise machine 200 are the same or very similar to corresponding elements in exercise machine 10 and, in some cases, are identified by the same numerals as in the exercise machine 10. The structure and function of these common or similar elements will not be repeated herein, except as is necessary to describe modifications in the structure. For example, the manner of retaining the exercise arms in an upper, locked position is the same (52, 54); the manner of providing a retractable stop (62) to limit the downward movement of the exercise arms, when desired, is the same and the manner of mounting the platform to the machine, including the structure of the platform (18, 20, 22 and 24), is the same. In addition, exercise machine 200 includes a locking arrangement to lock the platform in an open, operative position, to be described in detail hereinafter.

As described in connection with exercise machine 10, by including platform 18 in the exercise machine 200 an individual thereon, either alone or with a bench 40 or other support, provides a stabilizing force for the exercise machine. The same benefit is achieved by employing platform 18 in exercise machine 200. An alternative or additional manner for stabilizing the exercise machine 200 is to bolt or otherwise connect frame members of the exercise machine 200 to the floor or other supporting surface of the machine, including a vertical wall located adjacent the exercise machine.

Figure 18:
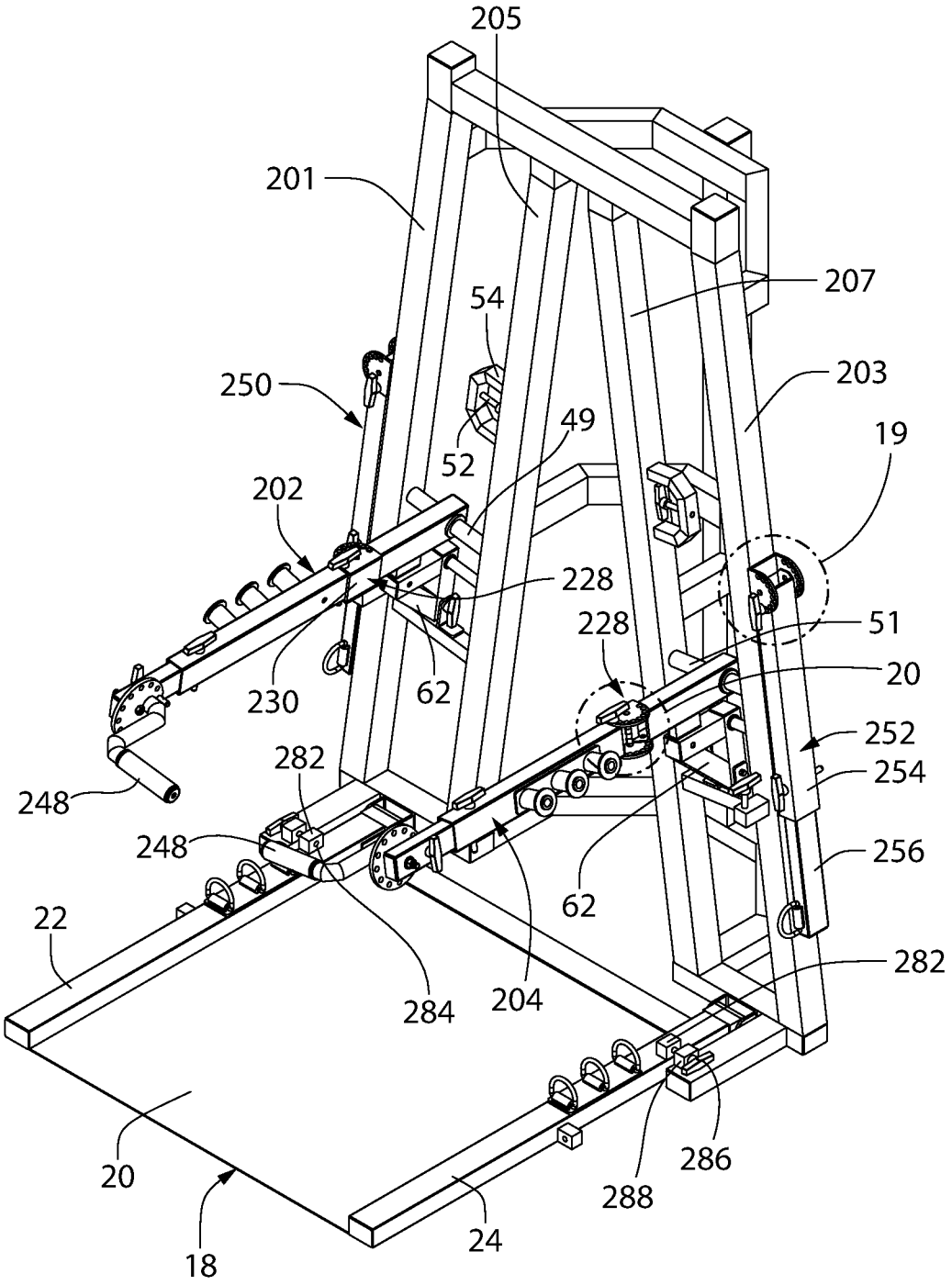
FIG. 18, is a front prospective view similar to FIG. 17, but in an opened condition for use.
Figure 21:
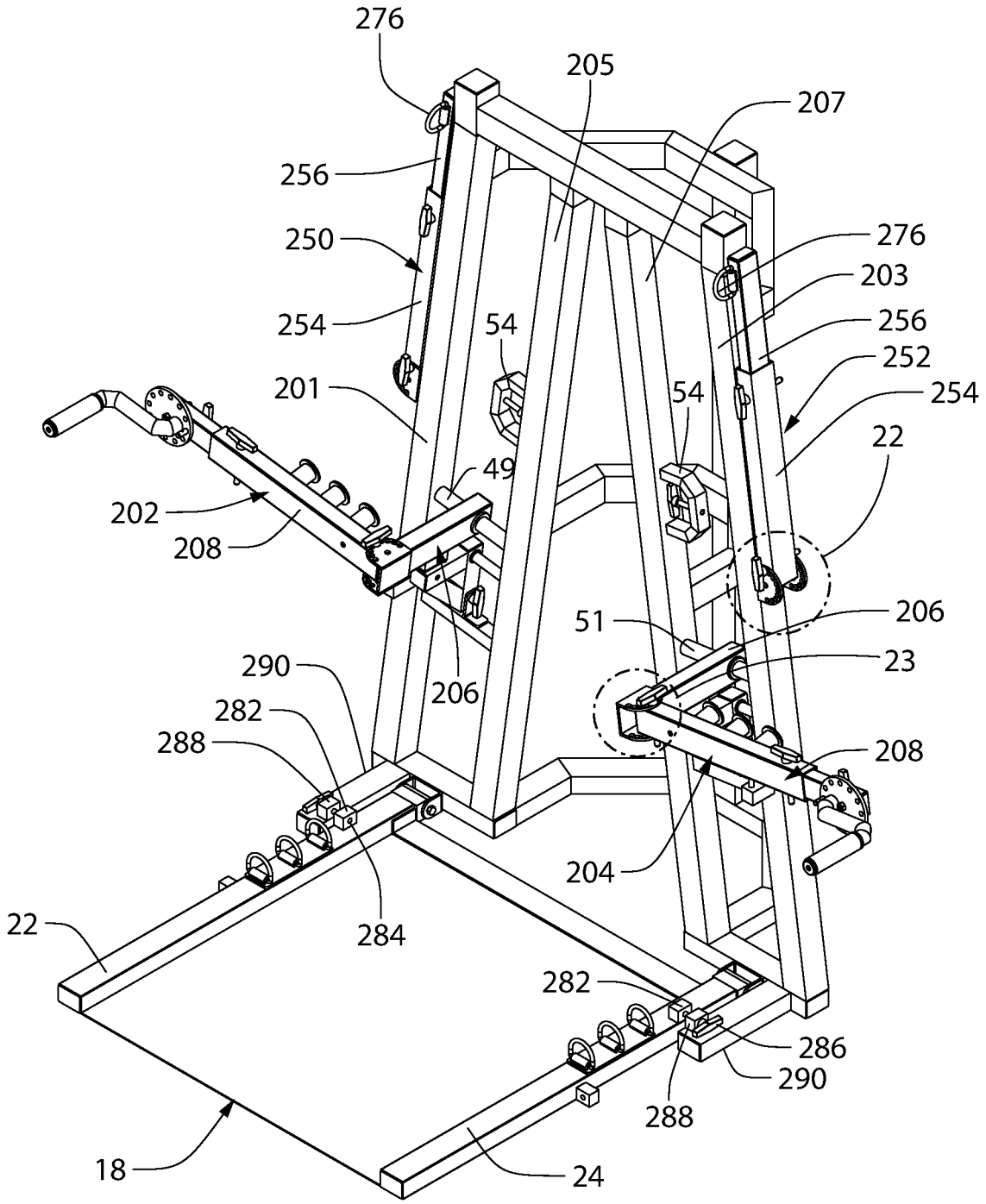
FIG. 21 is a prospective view similar to FIG. 18, but showing outer sections of the exercise arms in an outermost, rotational position relative to inner sections of said exercise arms.
Figure 24:
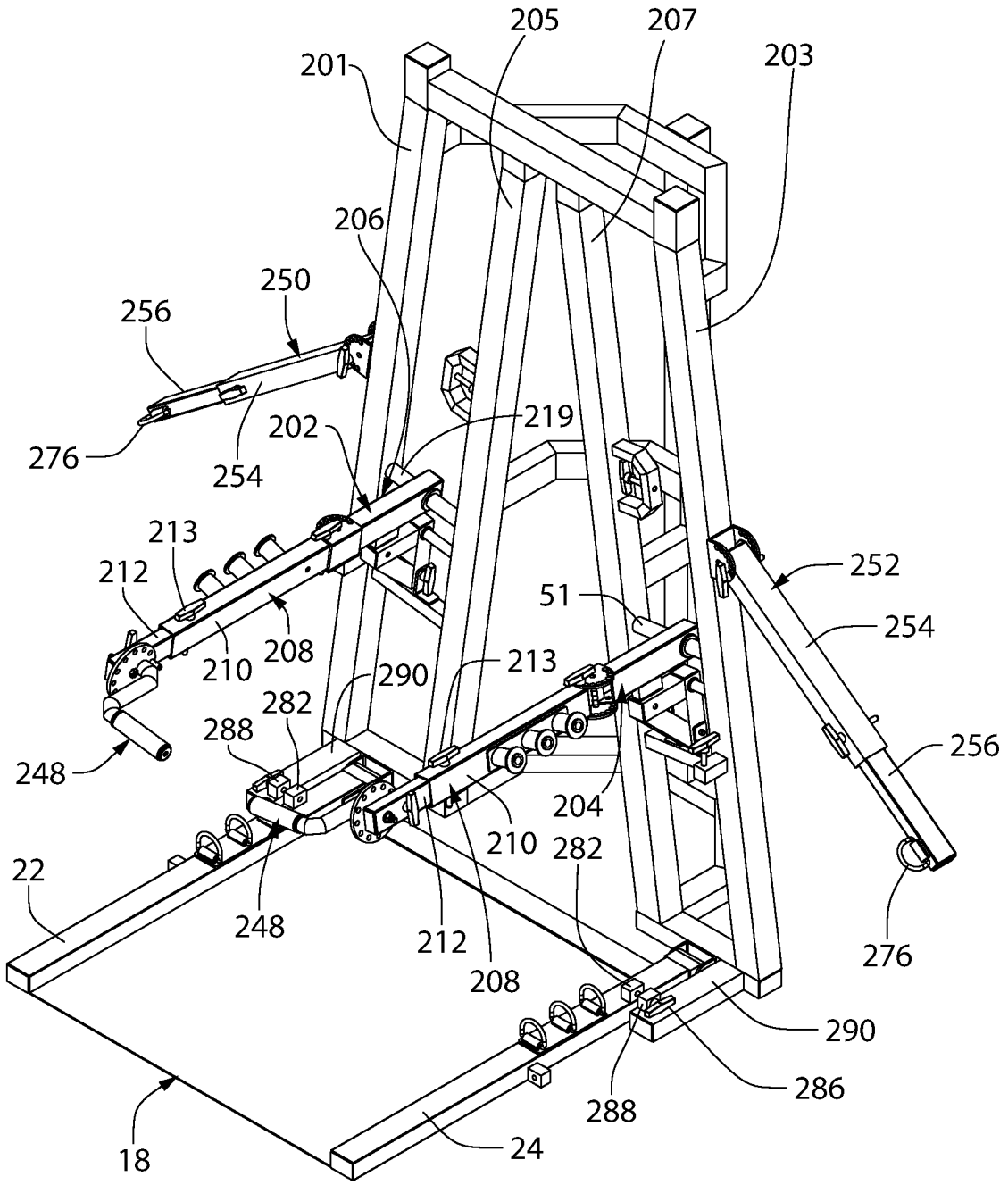
FIG. 24 is a prospective view similar to FIG. 18 but showing side arms thereof in a different rotational position.

Referring to FIGS. 18, 21 and 24-29, a locking arrangement is disclosed for maintaining platform 18 in its open, operative position. Each of the frame members 22 and 24 includes a member 282 on an upper surface thereof and having an opening 284 (FIG. 21) therein. Referring to FIGS. 18, 21 and 24, a locking pin 286 preferably is spring loaded within locking pin-retaining members 288 included on the upper surface of supports 290 adjacent the outer side of each frame member 22 and 24 of the platform 18. Each locking pin-retaining member 288 is located adjacent a respective locking member 282 on the upper surface of frame members 22 and 24 when the platform 18 is in its open, operative position so that each locking pin 286 is inserted into opening 284 to maintain the platform 18 locked in its desired, operative position.

Figure 17:
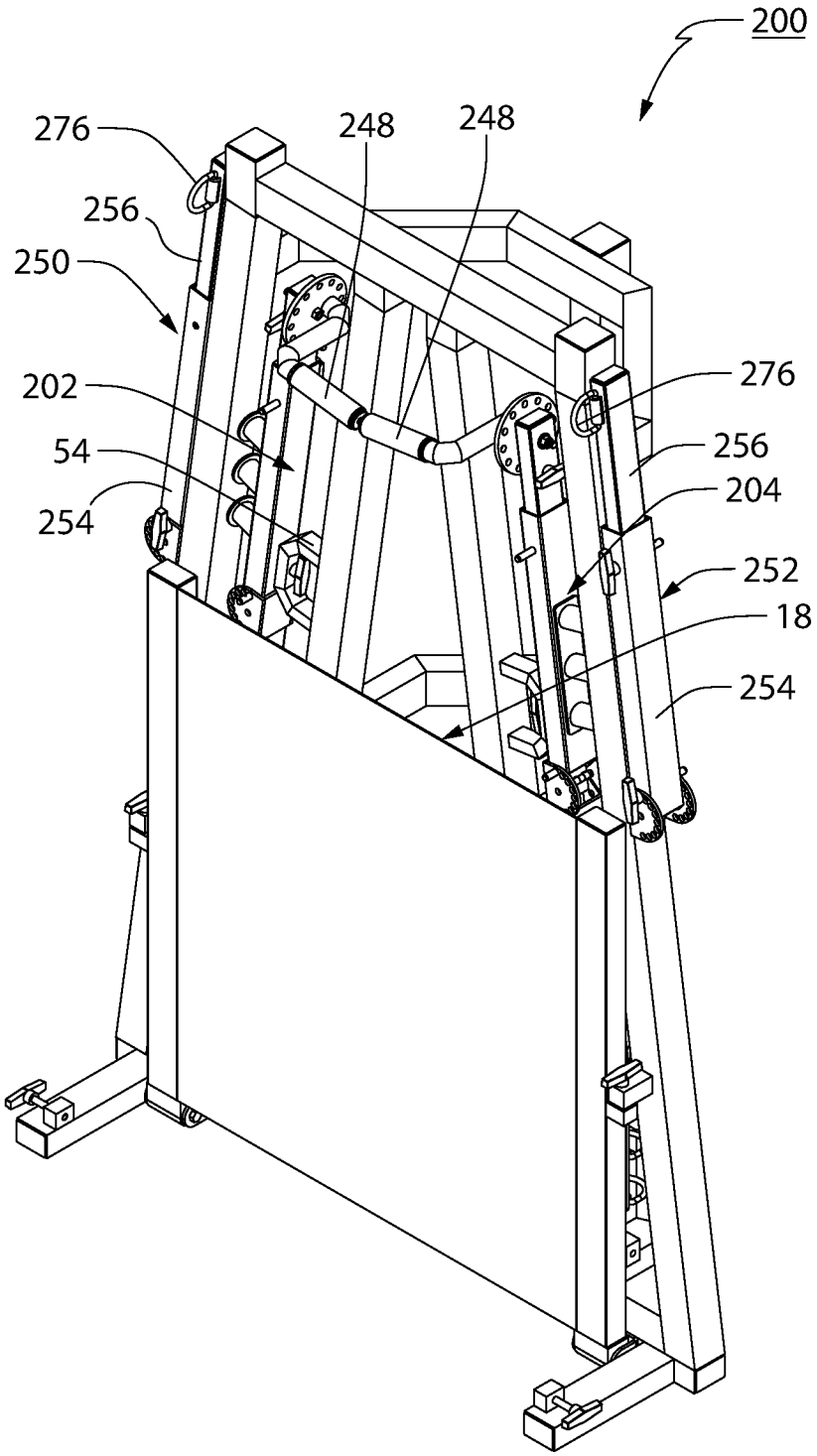
FIG. 17 is a front prospective view of the most preferred embodiment of an exercise machine of this invention in a retracted condition for storage, prior to use.

Referring to FIGS. 18, 21 and 24-29, in order to provide a more compact construction than exercise machine 10, and also to provide a more desirable biomechanical arrangement for movement of exercise arms 202, 204 in the exercise machine 200 upstanding, spaced-apart frame members 201, 203 and upwardly extending frame members 205, 207 of the exercise machine are inclined toward each other in an upward direction. This more compact arrangement results in spaced apart exercise arms 202, 204 in exercise machine 200 being transversely closer together than the spaced apart exercise arms 48, 50 in exercise machine 10. In fact, as can be seen in FIG. 17, outer ends of hand grips or handles 248 of the exercise arms 202, 204 are spaced only a small distance apart in the uppermost, rotational position of the exercise arms. With exercise arms 202, 204 in a generally horizontal position, as shown in FIG. 18, the outer ends of the handles 248 are transversely spaced from each other a greater distance than in the uppermost most position but the arms still may be too close to each other to accommodating individuals of a variety of sizes, but for the unique construction of the exercise arms 202, 204, as will be described in detail hereinafter.

Referring to FIGS. 18, 21 and 24-29, axle 49 in the exercise machine 200 is attached to and between upstanding frame member 201 and upwardly extending frame member 205 at approximately 90 degrees to said frame members. Thus, the axle 49 in the exercise device 200, unlike axle 49 in the exercise device 10, is at an angle relative to the surface supporting the machine 200 for rotatably mounting the exercise arm 202 for rotational, upward and downward movement. This same arrangement is provided for axle 51, which is attached to upstanding frame member 203 and upwardly extending frame member 207 and rotatably supports exercise arm 204 in a position transversely spaced from exercise arm 202. In the most preferred embodiment, and unlike exercise machine 10, the exercise arms 202, 204 are limited to rotational motion about axles 49, 51, i.e., the exercise arms are not mounted for axial movement along axles 49 and 51.

Due to the inclination of axles 49 and 51, when the exercise arms 202, 204 are rotated upwardly during an exercise the gripping handles 248 thereof, which are gripped by the exerciser, are moved inwardly toward each other, and when the gripped handles are moved downwardly they are moved outwardly away from each other. This is a very desirable biomechanical arrangement for exercising; following more naturally the normal movement of the exerciser's arms than the arrangement employed in exercise machine 10. In exercise machine 10 the gripping handles 74, 76 of the exercise arms 48, 50 maintain the same transverse-spacing from each other during both upward and downward movement of the exercise arms about their respective axles 49, 51.

Referring to FIGS. 18, 21 and 24-29 exercise machine 200, unlike exercise machine 10, includes transversely spaced-apart side arms 250, 252 rotatably mounted to the inclined frame members 201, 203 to provide unique functions described in detail hereinafter.

Figure 26:
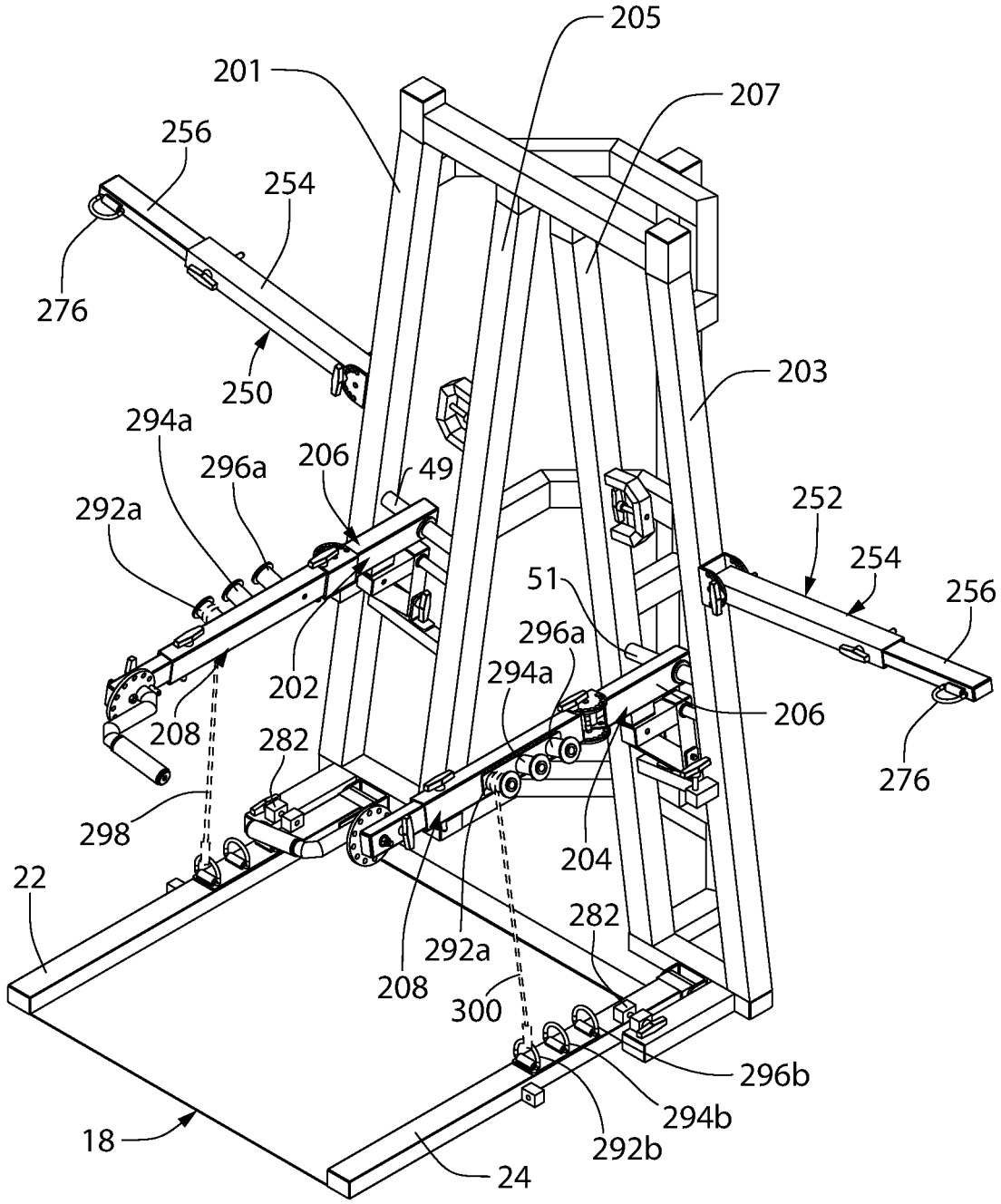
FIG. 26 is a prospective view similar to FIG. 25 but showing the telescopic sections of the side arms in a retracted position relative to the position shown in FIG. 25.
Figure 27:
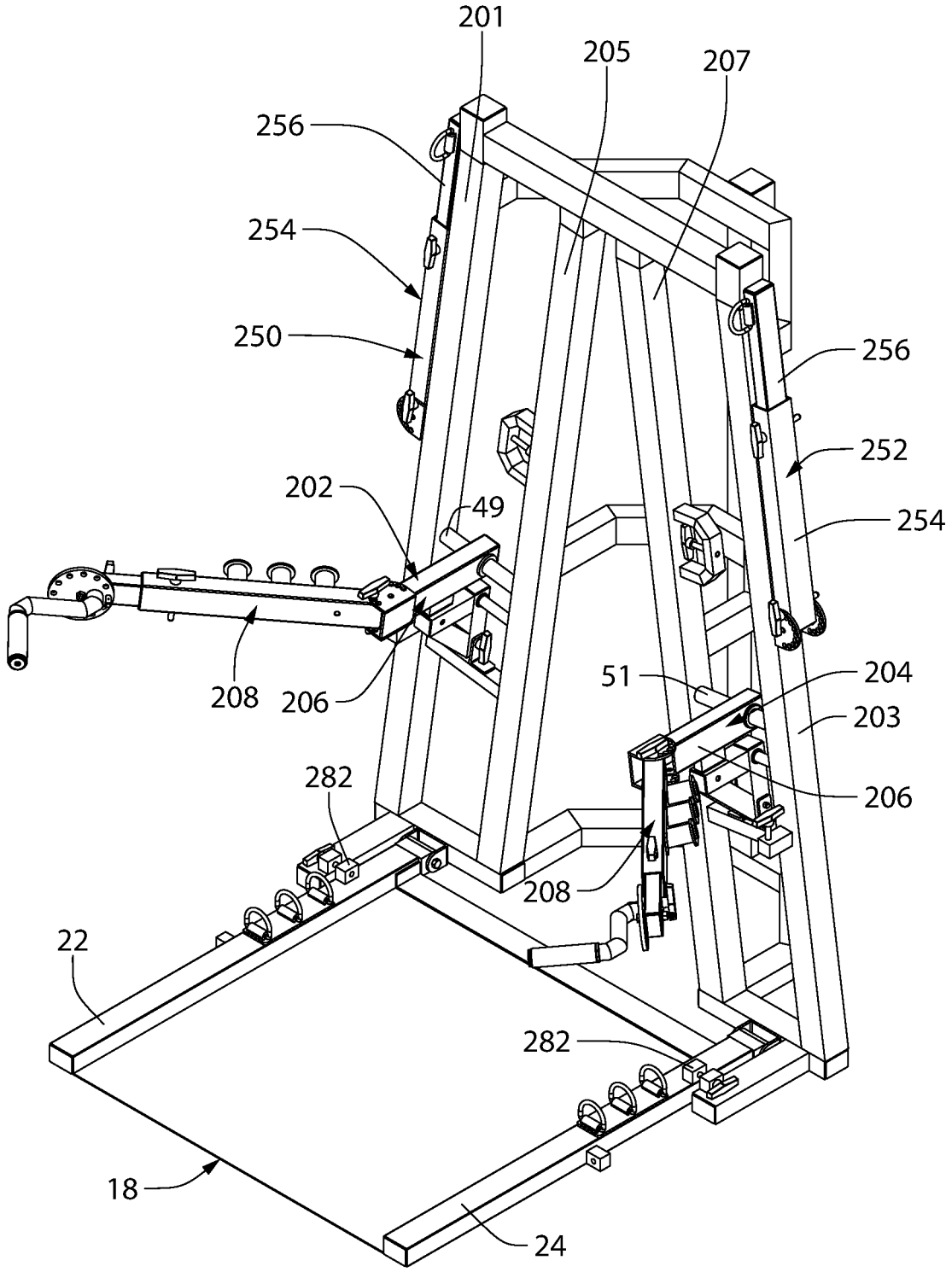
FIG. 27 is a prospective view similar to FIG. 18, but showing the side arms in an uppermost position and the inner and out sections of the exercise arms in a different rotational orientation relative to each other.

Referring to FIGS. 26 and 27. exercise arms 202, 204 in the exercise machine 200 each include inner and outer sections 206, 208 pivotally connected together through a hinge connection 214 as is best shown in FIGS. 18, 20, 21 and 23. This hinge connection 214 will be described in detail later herein Referring to FIGS. 26-28, the outer sections 208 of each exercise arm 202, 204 include transversely spaced-apart pins 292*a*, 294*a* and 296*a* extending transversely therefrom; each including an enlarged flange 297 at the outer end thereof. Spaced-apart D-rings 292*b*, 294*b* and 296*b* are attached to frame members 22, 24 of platform 18. The spaced apart pins and spaced-apart D-rings provide three sets of connectors 292*a* and *b*, 294*a* and *b*, and 296*a* and *b*, respectively. The number of sets can be varied as desired; six such sets being illustrated in the exercise machine 10. In fact, if desired only a single set of connectors can be employed, if desired. The number of sets of connectors and the specific construction of the connectors do not constitute a limitation on the broadest aspects of this invention; the only requirement being that the connectors of each set be oriented and constructed to retain one more exercise bands, e.g., 298, 300 in the machine for stretching when the exercise arms 202, 204 are rotated in an upward direction, as viewed in FIG. 26.

Referring to FIG. 26, the preferred manner of connecting one or more exercise bands 298, 300 to sets of connectors is shown in phantom. Specifically, both exercise bands 298, 300 have their ends thereof connected to a respective D-ring, e.g., 292*b* or other connector by a carabineer or other suitable connector attached to the free ends of said exercise bands. The exercise bands 298, 300 are then stretched and inserted over a respective pin, e.g., 292*a* to be maintained under tension prior to being rotated upwardly during an exercise. The provision of the enlarged flange 297 at the distal end of each pin prevents the exercise band(s) connected to the corresponding pin from inadvertently sliding off of, or otherwise inadvertently separating from the corresponding pin. The exercise arms 202, 204, prior to conducting an exercise, are maintained in a desired rest position by engaging the cushioning pads 70 on the upper surfaces 72 of the arm-engaging members 62.

Although the arrangement for connecting exercise bands 298, 300 to the sets of pins and D-rings, as described above, is the preferred connecting arrangement employed in the exercise machine 200, in accordance with the broadest aspects of this invention other arrangement can be employed to attach exercise bands 298, 300 to the exercise arms 202, 204, and to one or more frame members of the machine located below the rotational axles 49, 51 of said exercise arms, respectively. By way of example, and not by way of limitation, the exercise bands 298, 300 can be connected to the D-rings and pins through connector 100 in the same manner as in the exercise machine 10. Also, the exercise bands can be designed of a length to permit opposed ends to be connected to one or more sets of D-rings and to pins through suitable connectors. For example, the opposed ends of the exercise bands can include carabineers or other suitable connectors to be attached to a D-ring, e.g., 292*b* and a correspond pin 292*a*, e.g., through a connector 100 of the type employed in the exercise machine 10.

Figure 25:
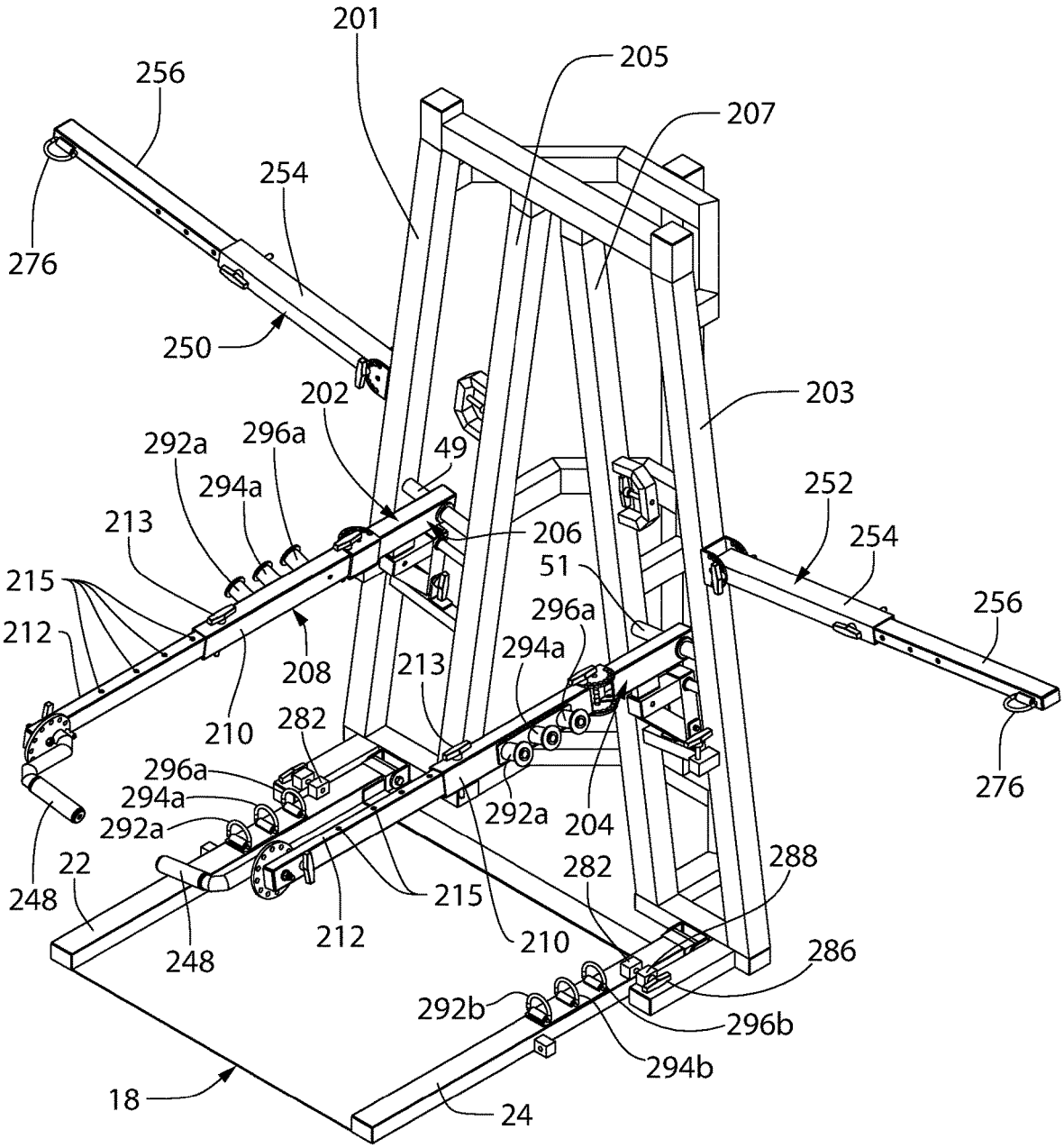
FIG. 25 is a prospective view similar to FIGS. 18 and 24 but showing the side arms in yet a further rotational position and with telescopic sections thereof being in an extended position.

Referring to FIGS. 24 and 25, outer sections 208 of the exercise arms 202, 204 each include outer and inner telescopic members 210, 212, respectively, and the exercise handles 248 are rotatably mounted to the distal ends of the inner telescopic members 212. A locking pin 213, preferably a spring-loaded locking pin, is retained in an opening through a top wall of each of the outer telescopic members 210, and normally is biased in an inward direction. The inner telescopic member 212 includes a plurality of axially spaced-apart openings 215 therein (FIG. 25) that are aligned with the locking pin 213, whereby, when the inner telescopic members 212 are in a desired position with respect to their corresponding outer telescopic members 210, the locking pin will engage within one of said axially spaced-apart openings 215 to maintain the inner telescopic member 212 locked against movement relative to the outer telescopic manner 210. This telescopic arrangement of outer sections 208 of the exercise arms 202, 204 permits adjustment of the length of each of the exercise arms to accommodate individuals of different sizes and/or to permit an individual to adjust the length of the exercise arms to carry out different exercises. FIGS. 24 and 25 show, respectively, the inner telescopic members 212 in different telescopic positions within outer telescopic members 210, respectively.

Figure 20:
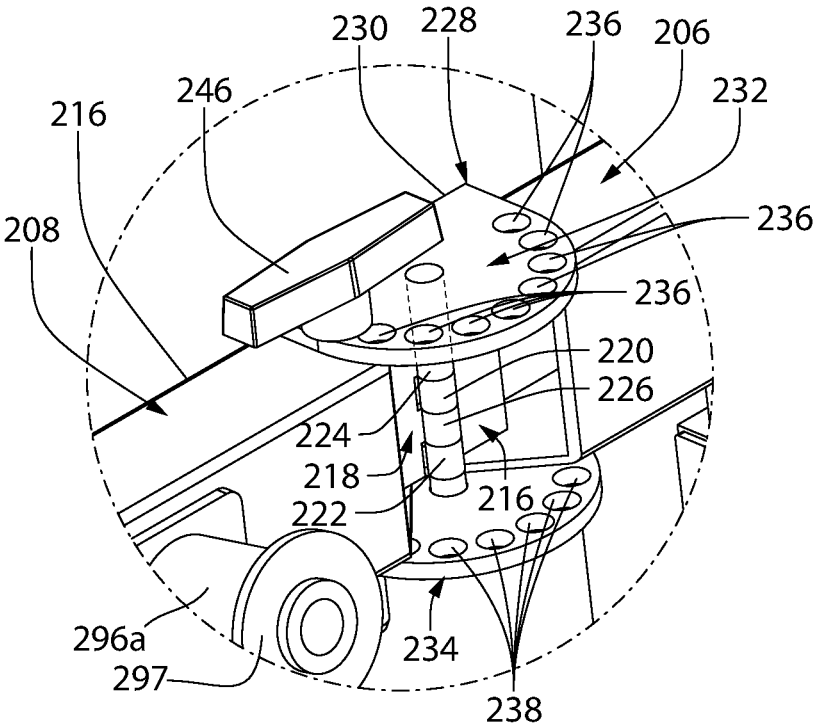
FIG. 20 is an enlarged view of the circled region of the exercise machine identified as "20" in FIG. 18.

As can be seen best in FIG. 20, plate-like extensions 216, 218 of inner and outer sections 206, 208, respectively, have annular end sections rotatably mounted on an axle (not visible). It should be noted that the outer telescopic member 210 of outer section 208 of each exercise arm 202, 204 is the member that is rotatably mounted on the axle that rotatably connects inner and outer sections 206, 208 of the exercise arms together. Still referring to FIG. 20, plate-like extension 216 includes spaced-apart annular end sections 220, 222 and plate-like extension 218 includes spaced-apart annular end section 224, 226. The annular end sections 220, 222 interdigitate with annular end sections 224, 226 to vertically align the passages through the annular sections 220, 222, 224 and 226 to be rotatably received on the axle (not shown). This arrangement rotatably connects together the inner and outer sections 206, 208 of each exercise arm 202, 204.

Referring to both FIGS. 18 and 20, a U-shaped member 228 for maintaining the inner and outer sections 206, 208 of each exercise arm 202, 204 in a desired rotational orientation relative to each other includes a base section 230 and vertically spaced-apart horizontally extending adjustment plates 232, 234 (FIG. 20) for receiving rotatably connected ends of the inner and outer sections of each exercise arm, respectively. These adjustment plates 232, 234 include a series of arcuately spaced apart openings; each arcuately spaced-apart opening 236 in adjustment plate 232 being vertically aligned with a corresponding opening 238 in adjustment plate 234. The ends of the inner and outer sections 206, 208 of the exercise arms received between the adjustment plates 232, 234 each have vertically aligned openings in upper and lower walls 242, 244 thereof (not visible) through which a locking pin 246 is received.

Figure 23:
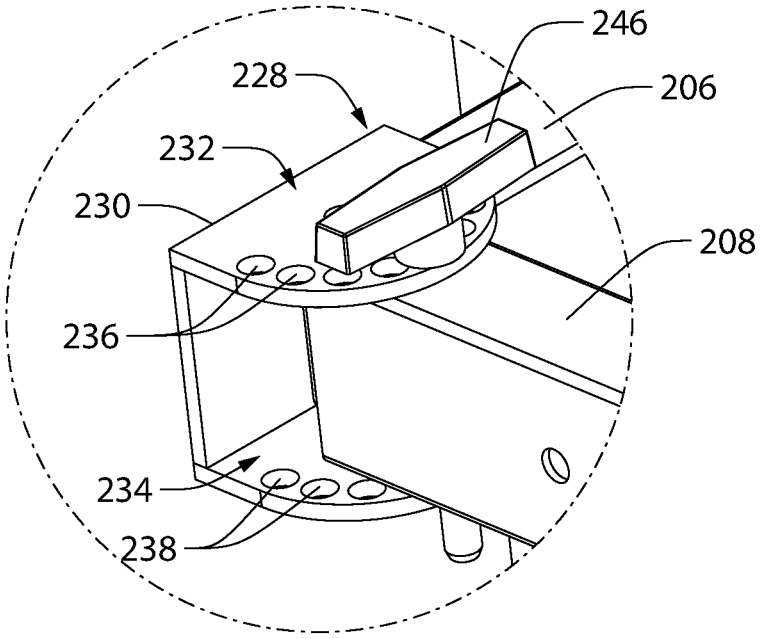
FIG. 23 is an enlarged view of the circled region of the exercise machine identified as "223" in FIG. 21.

As can be seen best in FIG. 20, the locking pin 246 is provided for retaining or maintaining the inner and outer sections 206, 208 of exercise arms 202, 204, respectively, in a desired orientation with respect to each other. By way of example, and not by way of limitation, as shown in FIGS. 21 and 23 the inner and outer sections 206, 208 of each exercise arm are maintained in a 90 degrees orientation with respect to each other. In this orientation locking pin 246 is inserted through vertically aligned openings 236, 238 in adjustment plates 232, 234, respectively, and through the aligned openings (not visible) in upper and lower walls of outer section 208.

The inner and outer sections 206 and 208 of exercise arms 202, 204 can be maintained in any desired angular position for conducting an exercise (e.g., see FIG. 27). By providing the above-described adjustment between the inner and outer sections 206, 208 of the exercise arms 202, 204 individuals of varying size easily can fit between the exercise arms for conducting numerous exercises. In addition, an individual may want to vary the spacing between the hand grips 248 of the exercise arms 202, 204 to conduct different exercises. These hand grips 248 can be of the same construction as the rotatably adjustable gripping handles 74, 76 employed in the exercise machine 10; mounted for adjustment in the same manner as in the exercise machine 10. For purposes of brevity this mounting arrangement of hand grips 248 will not be repeated herein.

If desired the locking pin 246 for maintaining the inner and outer sections 206, 208, respectively, in a desired angular position with respect to each other can be removed to permit continuous rotational motion of the inner and outer sections of each exercise arm 202, 204 relative to each other when an individual is engaged in an exercise by rotating the arms 202, 204 about their respective axles 49, 51.

Referring to FIGS. 17-19, 21, 22 and 24-26, the exercise machine 200 also includes side arms 250, 252, rotatably mounted to an outer surface of the upstanding spaced-apart frame member 201, 203, respectively, to provide functions to be described in detail hereinafter.

Each side arm 250, 252 is of an identical construction, including outer and inner telescoping section 254, 256, respectively. Section 256 is telescoped within section 254 for permitting linear adjustment of the length of the side arms 250, 252, and outer section 254 is rotatably mounted to the upstanding spaced-apart frame members 201, 203, as described in detail hereinafter. The rotatable mount of outer section 254 of side arm 250 to frame member 201 is identical to the rotatable mount of outer section 254 of side arm 252 to frame member 203. Therefore, the rotatable mount of the outer section 254 of only side arm 252 will be described in detail; it being understood that the outer section 254 of the side arm 250 is rotatably mounted in the same manner.

Figure 19:
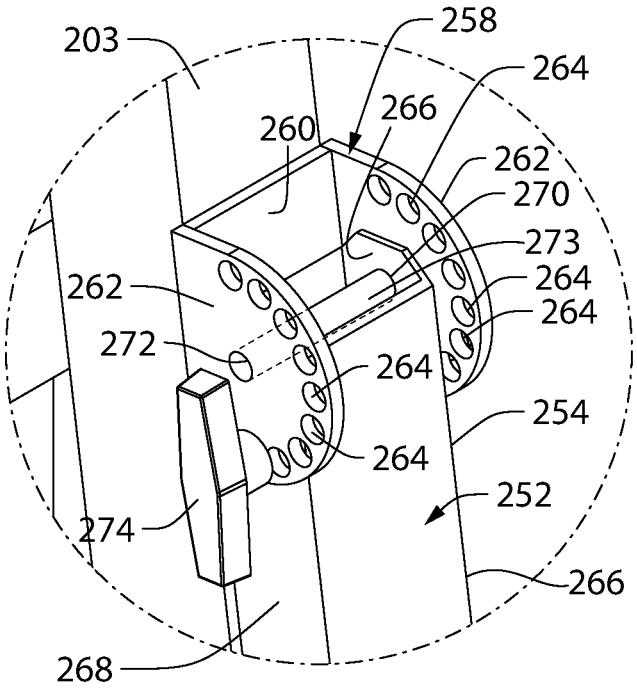
FIG. 19 is an enlarged view of the circled region of the exercise machine identified as "19" in FIG. 18.
Figure 22:
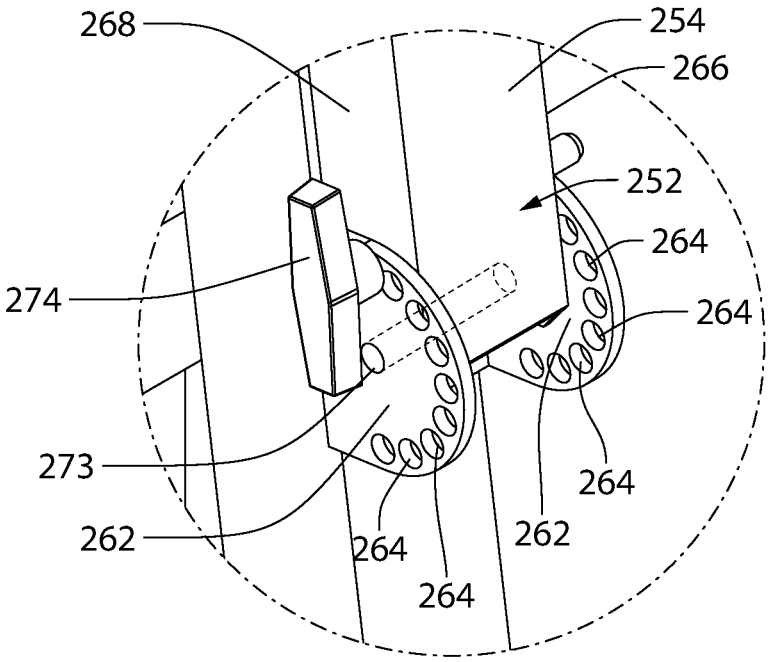
FIG. 22 is an enlarged view of the circled region of the exercise machine identified as "22" in FIG. 21.

Referring to FIGS. 19 and 22, a U-shaped mounting member 258 includes a base 260 secured to upstanding frame member 203 by welding, bolting, or any other suitable means. The U-shaped mounting member 258 includes transversely spaced-apart adjustment plates 262 extending outwardly from base 260; each including arcuately spaced-apart openings 264 adjacent an outer edge of said adjustment plates for rotatably adjusting the orientation of the side arms 250, 252. The transversely spaced-apart adjustment plates 262 also include axially aligned openings 272 (one being shown in FIG. 19) for receiving an axle, shown in phantom at 273 in FIG. 22 to rotatably receive a proximal end of the outer telescopic section 254 thereon. Specifically, diametrically opposed side walls 266, 268 of outer telescopic section 254 include axially aligned passages 270 therein (only one being shown in FIG. 19), and these axial aligned passages are axially aligned with diametrically opposed passages 272 in the spaced-apart adjustment plates 262 (only one being shown in FIG. 19). As can be seen in FIGS. 19 and 22 an axle 273 extends through passages 270 and 272 to rotatably support outer telescopic section 254. In accordance with the broadest aspects of this invention, arrangements other than employing U-shaped mounting members 258 can be employed to rotatably mount side arms 250, 252 to upstanding spaced apart frame members 201, 203; the particular arrangement not constituting a limitation on the broadest aspects of this invention.

The diametrically opposed side walls 266, 268 of the outer telescopic section 254 also include a second set of axially aligned passages (not shown) spaced distally from axially aligned passages 270. The linear distance between the passages 270 and the second set of passages is approximately the same as the radial distance between passages 272 and the arcuately spaced-apart openings 264 in adjustment plates 262.

As can be seen best in FIGS. 19 and 22, a locking pin 274 is provided to lock the side arms 250, 252 in a desired rotational position. By way of example, in FIG. 19 the side arm 252 is locked in its lowermost position shown in FIG. 18. In this position, the locking pin 274 extends through the lowest of the arcuately spaced-apart openings 264 in the adjustment plates 262, and through aligned, diametrically opposed openings (not shown) in the diametrically opposed side walls 266, 268 of the outer telescopic section 254.

Referring to FIG. 22, the side arm 252 is locked in its uppermost position shown in FIG. 21. In this position, the locking pin 274 extends through the uppermost of the arcuately spaced-apart openings 264 in the adjustment plates 262, and through aligned, diametrically opposed openings (not shown) in the diametrically opposed side walls 266, 268 of the outer telescopic section 254.

The side arms 250, 252 can be maintained in a number of different rotational positions, dictated by the number of arcuately spaced-apart openings 264 provided in the adjustment plates 262. For example, note the different, locked, rotational positions of the side arms 250, 252 in FIGS. 18, 21, 24, 25, 28 and 29.

In addition, forming the side arms 250, 252 with outer and inner telescopic sections 254, 256 permits adjustment of the length of the side arms, which is desirable for providing different exercises and also for connecting flexible tension bands to exercise arms 202, 204, as will be described in detail hereinafter.

Figure 28:
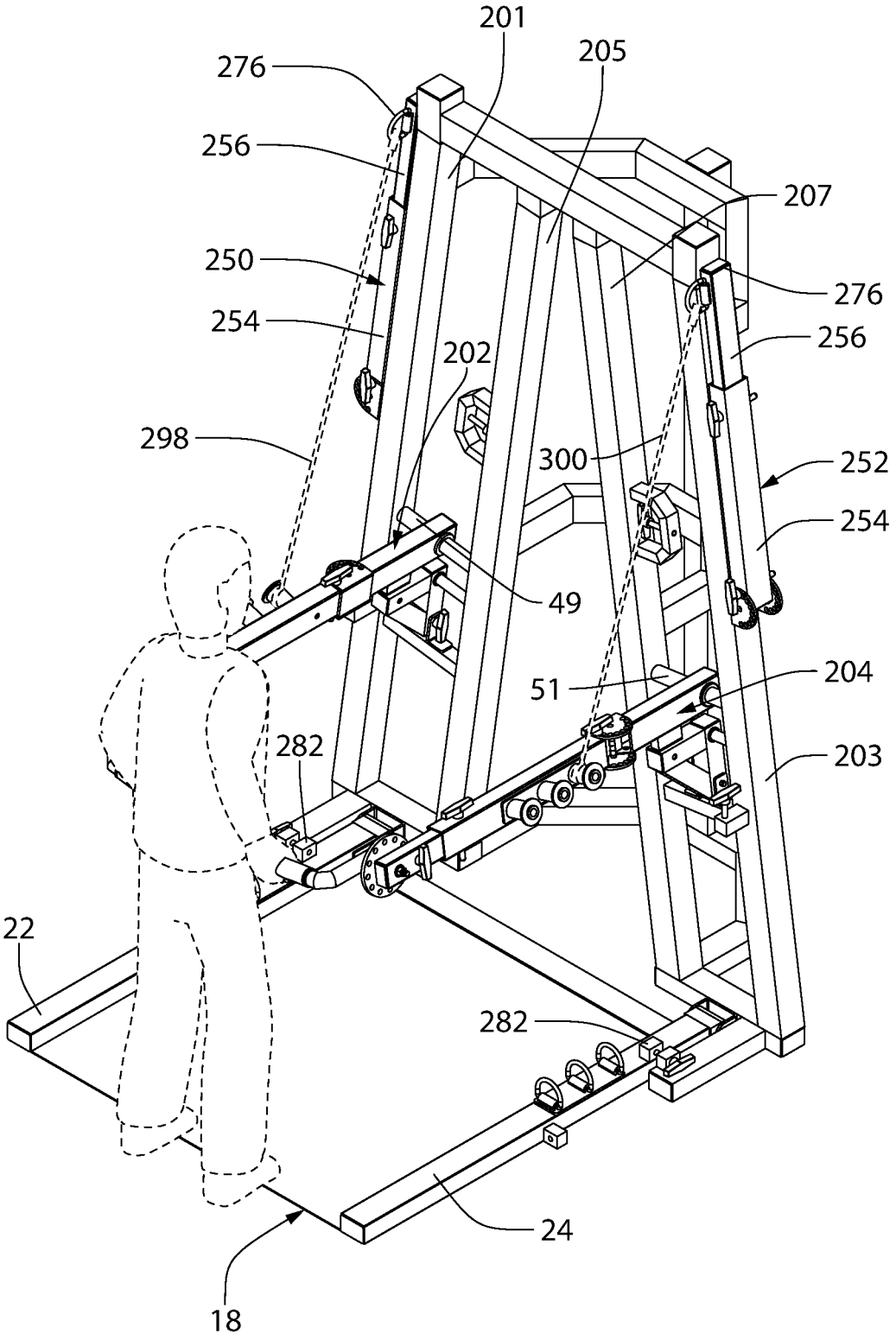
FIG. 28 is a prospective view similar to FIG. 18, but with the side arms in their uppermost position for cooperating with the exercise arms to retain one or more flexible tension bands under tension as an individual, shown in phantom, moves the exercise arms in a downward, rotational direction during an exercise.
Figure 29:
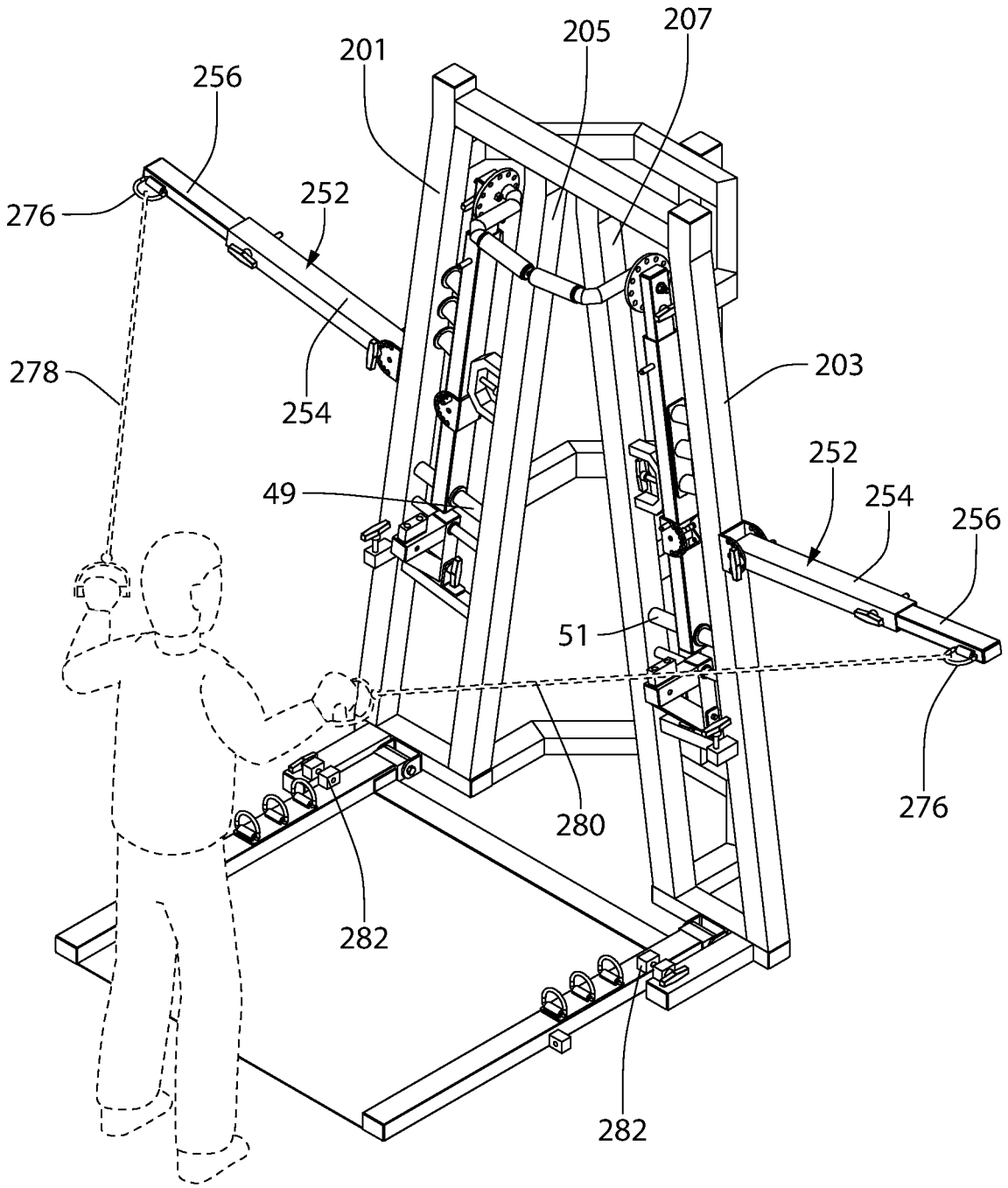
FIG. 29 is a prospective view similar to FIG. 26, but with the exercise arms in a retracted position; showing use of the side arms in retaining flexible tension bands and showing an individual, in phantom, conduction an exercise with the flexible tension bands.

As best seen in FIGS. 24 and 25, in the preferred embodiment of this invention, the inner telescopic sections 256 of the side arms 250, 252, are provided with attachment members 276 at the distal ends thereof to which a flexible tension band can be attached (see FIGS. 28 and 29). In the illustrated embodiment, the attachment members 276 are in the form of D-rings. However, within the broadest scope of this invention the attachment members can be of a variety of designs; depending in part on how it is desired to attach the flexible tension bands in the machine 200.

Referring to FIG. 29, and by way of example only, an exerciser employing flexible tension bands 278, 280, (shown in phantom representation for purposes of clarity) in an exercise independently of the exercise arms 202, 204 is shown. These flexible tension bands 278, 280 can include a carabineer at an end thereof to be attached to the D-rings 276 or to any other acceptable attachment member. The opposed ends of the tension bands 278, 280 can include handles or other gripping means to be engaged by an individual doing a desired exercise, e.g., flies or other pulling exercises.

Referring to FIG. 28, another desired benefit of the exercise arms 202, 204 is shown. In this arrangement, the exercise arms 202, 204 initially are supported on arm-engaging members 62, prior to connecting exercise bands 298, 300 to said exercise arms. Thereafter, the arm-engaging members can be rotated to an inactive position so as not to impede downward movement of the exercise arms 202, 204 during a downward pushing or pulling exercise.

Still referring to FIG. 28, flexible tension bands 298, 300, shown in phantom representation, are connected to the D-rings 276 or other suitable attachment members at distal ends of the inner telescopic sections 256 of the side arms 250, 252. When D-rings or other looped attachment members are employed, the distal ends of one or more flexible tension bands, e.g. 298, 300 can be connected thereto through carabineers or other suitable attachment members in the same manner as described in connection with the attachment of the exercise bands 298, 300 to the D-rings 292*b*, 294*b*, 296*b* attached to frame members 22, 24, of the platform 18. After attaching the distal ends of the tension bands to the D-rings 276, the exercise bands are stretched and inserted over the pins, e.g., 292*a*, 294*a* and/or 296*a* in the same manner as the flexible tension bands 298, 300 are connected to said pins to provide an upward pulling or pushing exercise, as shown in FIG. 26. Although this is the preferred embodiment for connecting the tension bands to the D-rings 276 and pins, respectively, in accordance with the broadest aspects of the invention other connecting arrangements can be employed. For example, one or more flexible tension bands can be looped through the D-rings 276, and the free, distal ends thereof can be connected to the pins 292*a*, 294*a* and/or 296*a* through a suitable connector, such as the connector 100 employed in the exercise machine 10. Within the broadest aspects of this invention any suitable connection means can be employed provide the arrangement permits stretching the tension bands during downward rotation of the exercise arms 202, 204. As noted earlier, the provision of the enlarged flange 297 at the distal ends of the s prevent the inadvertent separation of the exercise bands from such pins.

The initial connection of the flexible tension bands 298, 230 to the D-rings 276 and pins, e.g. 292 a is made with the flexible tension bands in a relaxed, non-stretched condition. In order to raise the exercise arms 202, 204 to a desired position for permitting a downward pulling or downward pushing exercise against the resistive force of stretched flexible bands 290, 300 the inner telescopic section 256 of each of the side arms 250, 252 is moved outwardly. This initially will remove any slack in the attached flexible exercise bands and thereafter will rotate the exercise arms 202, 204 in an upward position, with the hand grips 248 above the rotational axles 49, 51 for the exercise arms. In this orientation the weight of the exercise arms will maintain the flexible tension bands in a taut condition and possibly stretch the exercise bands to a limited extent prior to use.

Referring to FIG. 28, an individual is shown in phantom pushing or pulling the exercise arms 202, 204 in a downward, rotational path about axles 49, 51 against a resistive force provided by one or more flexible tension bands 298, 300 connected to the attachment members 276 of the side arms 250, 252 and to the exercise arms 202, 204 through mounting pins 292*a*, 294*a* and/or 296*a* connected to said exercise arms. It should be emphasized that in connection with the broadest aspects of this invention any suitable arrangement can be provided for attaching the flexible tension bands 298. 300 to the side arms 250, 252 and to the exercise arms 202, 204, including but not limited to the manner in which the one or more flexible tension bands are, or can be connected to the platform 18 and exercise arms 48, 50 in the exercise machine 10, as described earlier in this application. That description will not be repeated herein for purposes of brevity.

The above description is of the preferred embodiments of the exercise machines. However, a number of modifications can be made withing the scope of this invention. For example, although six (6) sets of connectors are disclosed in the exercise machine 10 shown in FIGS. 1-12, permitting up to six exercise bands to be individually employed, any desired number of sets can be utilized in the machine. In fact, in the exercise machine 200 three (3) such sets of connectors are utilized.

Also, in accordance with the broadest aspects of this invention, any desired system can be provided for connecting one or more exercise bands within the exercise machines 10 or 200; provided that the system permits the band(s) to be stretched during an exercise to provide a counteracting tension when the exercise arms are rotated either in an upward or a downward direction during an exercise.

As noted earlier, the flexible exercise bands employed in accordance with the broadest aspects of this invention do not need to include carabiners as connectors. However, carabineers are commonly employed on flexible exercise bands and are a preferred connecting structure.

Also, although in the preferred systems of exercise machines 10 and 200 conventional exercise bands can be employed to provide a desired counteracting tension force during an exercise, it is within the broadest scope of this invention to provide a specially designed flexible tension band to have a length permitting one of the opposed ends to be connected to an exercise arm, and the other of the opposed ends to be connected to a vertically spaced connector above and/or below the rotational axle of the exercise arm.

In the most preferred embodiments of this invention the flexible exercise bands that are employed are ones that also can be used independently of the exercise machines 10 and 200, and therefor are of the same or similar length as conventional exercise bands. The arrangement of essentially folding the exercise bands on themselves so that the distal ends thereof can be connected to one of the spaced-apart connectors in a set and central regions thereof can be stretch through or about the other of the spaced-apart connectors in said set permits the machines 10 and 200 to be used with flexible exercise bands that are of the same or similar length as convention exercise bands that have been employed and are employable independently of the exercise machines 10 and 200.

Although the present invention has been described in connection with preferred embodiments thereof, it will be appreciated by those skilled in the art that other additions, modifications, substitutions and deletions not specifically described may be made without departing from the spirit and scope of the invention defined in the appended claims.

What is claimed is:

1. An exercise machine employing one or more flexible tension bands, said exercise machine including:

a. a pair of exercise arms rotatably mounted on upwardly extending, transversely spaced-apart frame members vertically above a surface supporting the exercise machine, said pair or exercise arms being rotatably mounted on a rotatable mount on said frame members for upward and downward rotational motion, said pair of exercise arms being horizontally spaced-apart and each including a member to be engaged by opposed hands of an individual located between said pair of exercise arms, b. a pair of side arms rotatably mounted to said frame members for rotation between uppermost and lowermost positions and being configured to be locked in a plurality of rotational positions between and including said uppermost and lowermost positions, each of said side arms including at least one third connector adjacent an outer end thereof, c. a machine member connected to a lower portion of each of said frame members vertically below the rotatable mount of each exercise arm; and d. at least one set of connectors including at least one first connector connected to each of said pair of exercise arms, and at least one second connector vertically spaced-apart from said at least one first connector and being connected to said machine member and wherein said at least one third connector is connected to each of said side arms for being moveable to positions above and below the rotatable mount of each exercise arm, and e. at least one flexible tension band configured to be connected to said at least one first and said second, vertically spaced-apart connectors, whereby when said at least one flexible tension band is connected to said at least one first and said second, vertically spaced-apart connectors rotation of the exercise arms in an upward direction stretches said one or more flexible tension bands creating a tension force opposing the upward direction of rotation of the exercise arms, at least one flexible tension band configured to be connected to said first connector and the at least one third connector when said at least one third connector is vertically above the rotatable mount of each exercise arm, whereby when said at least one flexible tension band is connected to said first and third connectors rotation of the exercise arms in a downward direction stretches said one or more flexible tensions bands creating a tension force opposing the downward direction of rotation of the exercise arms.

2. The exercise machine of claim 1, further including a platform between the horizontally spaced-apart exercise arms and below the rotatable mount of the exercise arms to support an individual engaging the opposed arms during exercising, the weight of said individual aiding in stabilizing the exercise machine.

3. The exercise machine of claim 1, wherein said at least one flexible tension band includes opposed ends, one of said at least one first connector and of said at least one second connector being configured to engage said at least one flexible tension band intermediate said opposed ends, and one of said at least one first connector and said at least one third connector configured to engage said at least one flexible tension band intermediate said opposed ends when said at least one third connector is vertically above the rotatable mount of each exercise arm.

4. The exercise machine of claim 1, including a plurality of flexible tension bands, a plurality of first connectors connected to each exercise arm and a plurality of second connectors connected to said machine member vertically below the rotatable mount of each exercise arm for receiving and retaining said plurality of flexible tension bands.

5. The exercise machine of claim 1, wherein the second connectors are in the form of a closed loop configured to retain at least one flexible tension band thereto.

6. The exercise machine of claim 1, wherein said first connectors each includes a pin member connected to a respective exercise arm.

7. The exercise machine of claim 1, wherein each of said first connectors includes a pin member connected to a respective exercise arm and the second connectors are each in the form of a loop.

8. The exercise machine of claim 7, wherein opposed ends of at least one flexible tension band are connected to a loop and an intermediate section of said at least one flexible tension band is retained on a pin member.

9. The exercise machine of claim 7, wherein said loop is a D-ring.

10. The exercise machine of claim 1, further including a platform between the horizontally spaced-apart exercise arms and below the rotatable mount of the exercise arms to support an individual engaging the opposed arms during exercising, the weight of the individual aiding to stabilize said machine, said second connectors being loops attached to said platform.

11. The exercise machine of claim 1, each exercise arm including inner and outer sections rotatably mounted to each other about a vertical axis to permit rotational movement or rotatable adjustment of the outer section of each exercise arm relative to the inner section of each exercise arm during an exercise.

12. The exercise machine of claim 11, including a locking member being moveable between operative and inoperative positions, said locking member being configured to lock the rotatably mounted inner and outer sections of each exercise arm in one or more rotatable orientations relative to each other when said locking member is in an operative position.

13. The exercise machine of claim 11, said outer section of each arm including an outer member and a telescopic inner manner movable linearly within said outer member to adjust the length of each exercise arm and means for locking the inner member to said outer member when said each exercise arm is of a desired length.

14. The exercise machine of claim 1, each of the side arms being configured to be locked in a position in which the third connector attached adjacent an outer end thereof is spaced vertically above the rotational mount of a respective exercise arm.

15. The exercise machine of claim 14, each of said side arms is rotatably moveable in a plane substantially perpendicular to the plane in which each exercise arm is rotatably mounted for upward and downward rotational movement.

16. The exercise machine of claim 1, each of the side arms includes telescopic inner and outer sections, said outer sections being rotatably mounted to the upwardly extending, transversely spaced-apart frame members and said inner sections including said third connector adjacent an outer end thereof, said telescopic inner and outer sections permitting adjustment of the spacing between the rotatable connection of each outer section of a respective side arm to a respective frame member and the third connector adjacent an outer end of the telescopic inner section of said respective side arm, and adjustment of the spacing between said third connector and said first connectors on the exercise arms.

17. The exercise machine of claim 16, each of said side arms is rotatably moveable in a plane substantially perpendicular to the plane in which each exercise arm is rotatably mounted for upward and downward rotational movement.

18. The exercise machine of claim 1, wherein each of the side arms to which said at least one third connector is attached is rotatably moveable in a plane substantially perpendicular to the plane in which each exercise arm is rotatably mounted for upward and downward rotational movement.

* * * * *